US007100562B2

(12) United States Patent
Terada et al.

(10) Patent No.: US 7,100,562 B2
(45) Date of Patent: Sep. 5, 2006

(54) MULTICYLINDER INTERNAL COMBUSTION ENGINE

(75) Inventors: Koji Terada, Saitama (JP); Osamu Emizu, Saitama (JP); Ryushi Tsubota, Saitama (JP); Noboru Yamashita, Saitama (JP); Yoshiyuki Kasai, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/071,456

(22) Filed: Mar. 4, 2005

(65) Prior Publication Data

US 2005/0193974 A1 Sep. 8, 2005

(30) Foreign Application Priority Data

Mar. 4, 2004 (JP) ..... 2004-060695
Jan. 24, 2005 (JP) ..... 2005-016127

(51) Int. Cl.
*F02F 7/00* (2006.01)

(52) U.S. Cl. ..... 123/195 R; 123/196 R

(58) Field of Classification Search ..... 123/41.1, 123/196 R, 195 R, 195 H, 196 W; 184/6.5, 184/6.6

See application file for complete search history.

(56) References Cited

U.S. PATENT DOCUMENTS 5,901,680 A * 5/1999 Ozeki ..... 123/195 R
2003/0140888 A1 7/2003 Tanaka et al.

FOREIGN PATENT DOCUMENTS

| | | |
|---|---|---|
| DE | 38 05 389 A1 | 8/1989 |
| DE | 100 43 795 A1 | 3/2002 |
| EP | 1 394 383 A1 | 3/2004 |
| JP | 2002-276317 A | 9/2002 |

* cited by examiner

*Primary Examiner*—Henry C. Yuen
*Assistant Examiner*—Katrina Harris
(74) *Attorney, Agent, or Firm*—Birch, Stewart, Kolasch & Birch, LLP

(57) ABSTRACT

A V-type, multicylinder internal combustion engine with multiple isolated crank chambers formed by partitioning a space inside of a crankcase with multiple support walls for supporting a crankshaft, and multiple oil outlet holes, respectively communicating with the isolated crank chambers to separately discharge oil from the multiple isolated crank chambers, uses a single scavenging pump to discharge the oil from the isolated crank chambers rather than connecting multiple scavenging pumps, respectively, to the oil outlet holes. The engine includes an oil collecting pan mounted on a bottom wall of a crank chamber covering the multiple oil outlet holes respectively communicating with the multiple isolated crank chambers for collecting the oil passed through the oil outlet holes. The oil collecting pan has an oil reservoir with an oil outlet opening, and a single scavenging pump for drawing the oil stored in the oil collecting pan through the oil outlet opening.

20 Claims, 18 Drawing Sheets

MULTICYLINDER INTERNAL COMBUSTION ENGINE

CROSS-REFERENCE TO RELATED APPLICATION

The present application claims priority under 35 U.S.C. §119 to Japanese Patent Application No. 2004-060695, filed Mar. 4, 2004 and Japanese Patent Application No. 2005-016127, filed on Jan. 24, 2005, the entire contents of which are hereby incorporated by reference.

BACKGROUND OF THE INVENTION

1. Field of the Invention

The present invention relates to a multicylinder internal combustion engine having isolated crank chambers, and more particularly to oil discharging means and an oil passage for each isolated crank chamber.

2. Description of Background Art

In a conventional multicylinder internal combustion engine having isolated crank chambers, a plurality of scavenging pumps are connected to a plurality of oil outlet holes communicating with the isolated crank chambers, respectively, so as to discharge a lubricating oil from the isolated crank chambers (see, for example, Japanese Patent Laid-open No. 2002-276317 (FIG. 9)

SUMMARY AND OBJECTS OF THE INVENTION

It is an object of the present invention to provide a multicylinder internal combustion engine using a single scavenging pump for discharging the lubricating oil from the isolated crank chambers rather than connecting a plurality of scavenging pumps respectively to the oil outlet holes communicating with the isolated crank chambers. Further, the scavenging pump is rationally mounted. In addition, an oil passage is also improved, and an oil discharge efficiency from each isolated crank chamber is improved.

According to a first aspect of the invention, a multicylinder internal combustion engine is provided with a crankcase integrally formed with a plurality of support walls for supporting a crankshaft, a plurality of isolated crank chambers formed by partitioning a space inside of the crankcase with the support walls, and a plurality of oil outlet holes respectively communicating with the plurality of isolated crank chambers to separately discharge oil from the isolated crank chambers. The multicylinder internal combustion engine includes a crank chamber oil collecting pan mounted on a bottom wall of the crankcase so as to cover all of the oil outlet holes for collecting the oil passed through the oil outlet holes, the crank chamber oil collecting pan having an oil reservoir formed with an oil outlet opening; and a scavenging pump for drawing the oil stored in the crank chamber oil collecting pan through the oil outlet opening.

According to a second aspect of the invention, the scavenging pump is mounted on the crank chamber oil collecting pan.

According to a third aspect of the invention, the crank chamber oil collecting pan has an upper mount surface connected to the bottom wall, the upper mount surface being formed with a groove as an oil passage.

According to a fourth aspect of the invention, the multicylinder internal combustion engine further comprises a one-way valve for limiting the oil flow through the oil outlet holes between the isolated crank chambers and the crank chamber oil collecting pan to the unidirectional flow from the isolated crank chambers to the crank chamber oil collecting pan.

According to a fifth aspect of the invention, the crankshaft has at least a first crankpin to which a first piston is connected and a second crankpin to which a second piston is connected, the second piston being different from the first piston in timing of reaching a top dead center, and the one-way valve is provided for each of the isolated crank chambers respectively accommodating the first and second crankpins.

According to a sixth aspect of the invention, the crankshaft has a first crankpin to which two pistons different in timing of reaching a top dead center are connected and a second crankpin to which one piston is connected, and the one-way valve is provided for only one of the isolated crank chambers accommodating the second crankpin.

According to a seventh aspect of the invention, the one-way valve is accommodated in the oil reservoir of the crank chamber oil collecting pan and is operated to open or close according to the difference between a pressure in each isolated crank chamber and a pressure in the crank chamber oil collecting pan applied to a valve element, the one-way valve being shifted in position from the oil outlet opening in an axial direction of the scavenging pump.

According to an eighth aspect of the invention, the one-way valve is held between the crankcase and the crank chamber oil collecting pan.

According to the first aspect of the invention, the provision of the single scavenging pump is sufficient and it is not necessary to provide a plurality of scavenging pumps, thereby reducing the number of parts, simplifying the structure, and reducing the weight of the internal combustion engine.

According to the second aspect of the invention, the scavenging pump is directly mounted on the crank chamber oil collecting pan. Accordingly, it is not necessary to provide any independent mounting member, thereby reducing the number of parts.

According to the third aspect of the invention, the oil staying in the oil passages of the engine can be easily removed in performing maintenance, and the oil passages can be easily cleaned.

According to the fourth aspect of the invention, reverse flow of the oil from the crank chamber oil collecting pan to the isolated crank chambers can be prevented by the one-way valve. Accordingly, the discharge efficiency of oil from the isolated crank chambers through the oil outlet openings to the oil collecting pan can be improved.

According to the fifth aspect of the invention, even in a multicylinder internal combustion engine wherein a phase difference is generated in pressure change between the plural isolated crank chambers because of different phases of the pistons, reverse flow of the oil from the crank chamber oil collecting pan to each isolated crank chamber can be prevented by each one-way valve, so that the discharge efficiency of oil to the crank chamber oil collecting pan can be improved.

According to the sixth aspect of the invention, the one-way valve is provided for only the isolated crank chamber accommodating the second crankpin, so that it is possible to prevent the reverse flow from the crank chamber oil collecting pan to this isolated crank chamber, in which the reverse flow easily occurs. Moreover, the number of necessary one-way valves can be reduced, so that the number of parts can be reduced and an assembly man-hour and cost can therefore be reduced.

According to the seventh aspect of the invention, the one-way valve is located by utilizing the oil reservoir of the crank chamber oil collecting pan, so that an increase in size near the oil collecting pan can be suppressed in spite of the provision of the one-way valve. Moreover, also in the open condition of the one-way valve, the oil flow toward the oil outlet opening in the oil collecting pan is not hindered by the one-way valve.

According to the eighth aspect of the invention, any special member for mounting the one-way valve is not required, so that the number of parts can be reduced and an assembly man-hour and cost can therefore be reduced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

First Preferred Embodiment

Figure 1:
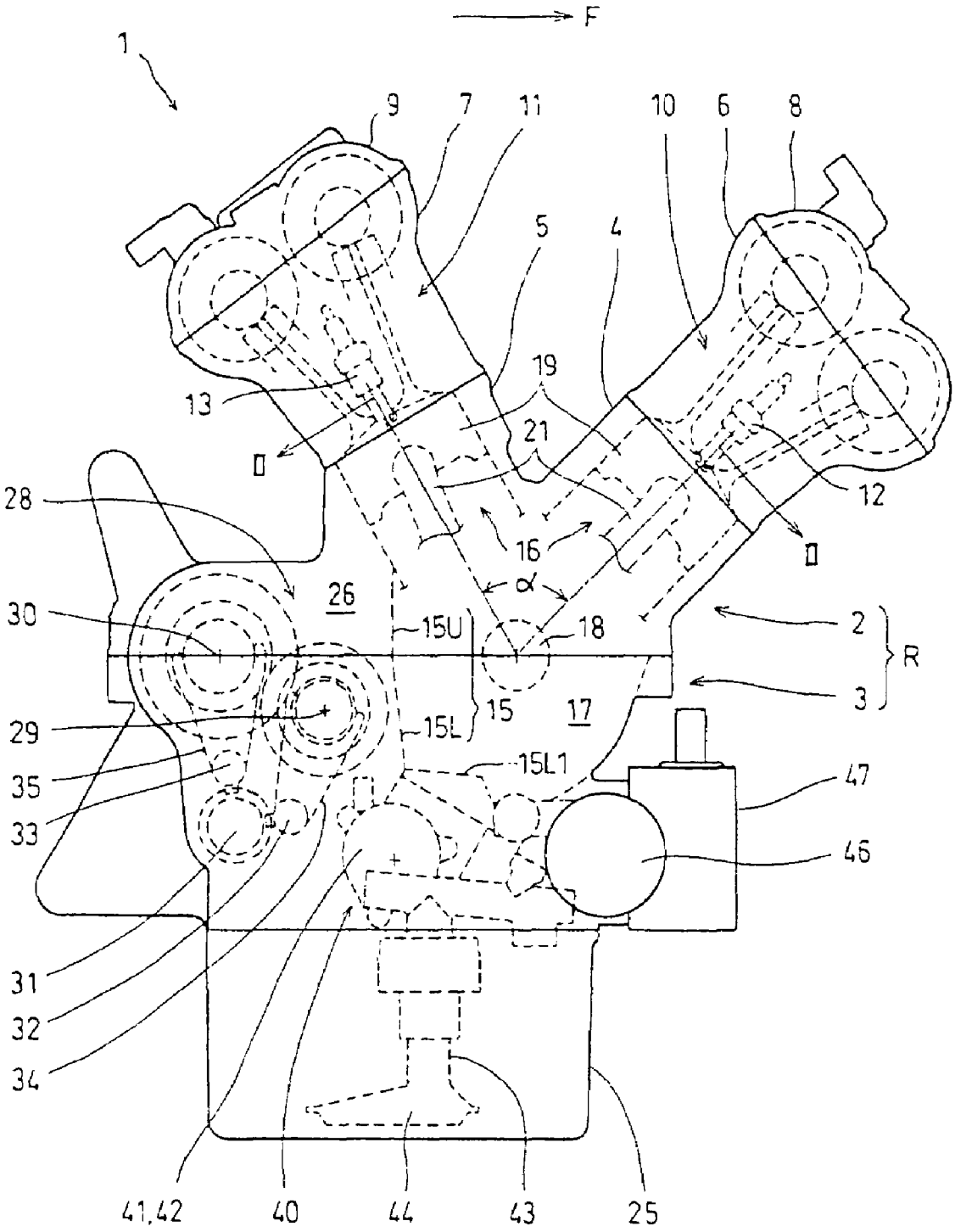
FIG. 1 is a side view of the DOHC, water-cooled, V-type, five-cylinder, four-cycle internal combustion engine 1 to be mounted on a motorcycle according to a first preferred embodiment of the present invention.

FIG. 1 is a side view of a DOHC, water-cooled, V-type, five-cylinder, four-cycle internal combustion engine 1 adapted to be mounted on a motorcycle according to the first preferred embodiment of the present invention. In FIG. 1, the arrow F indicates the front side of the engine 1 when it is mounted on the motorcycle. A central portion of the engine 1 is composed of an upper crankcase 2 and a lower crankcase 3. The upper crankcase 2 is integrally formed with a front cylinder block 4 inclined to the front side and composed of three cylinders and a rear cylinder block 5 inclined to the rear side and composed of two cylinders.

Therefore, the cylinder block of the engine 1 having the front and rear cylinder blocks 4 and 5 is composed of a plurality of (five in this preferred embodiment) cylinders. The angle a set between the front cylinder block 4 and the rear cylinder block 5 is about 75 degrees. A front cylinder head 6 and a rear cylinder head 7 are connected to the upper end surfaces of the front cylinder block 4 and the rear cylinder block 5, respectively.

Further, a front cylinder head cover 8 and a rear cylinder head cover 9 are connected to the upper end surfaces of the front cylinder head 6 and the rear cylinder head 7, respectively. The upper end surface of the lower crankcase 3 is connected to the lower end surface of the upper crankcase 2 to form an integrated crankcase R. A valve train 10 and a spark plug 12 are provided so as to correspond to each cylinder inside the front cylinder head 6 and the front cylinder head cover 8. Similarly, a valve train 11 and a spark plug 13 are provided so as to correspond to each cylinder inside the rear cylinder head 7 and the rear cylinder head cover 9.

A partition wall 15 is provided so as to extend from a longitudinally central, upper portion of the upper crankcase 2 to a lower portion of the lower crankcase 3. The partition wall 15 is composed of an upper partition wall 15U integrally formed as a part of the upper crankcase 2 and a lower partition wall 15L integrally formed as a part of the lower crankcase 3 and connected to the upper partition wall 15U. A space defined in the crankcase R on the front side of the partition wall 15 functions as a crank chamber 17 communicating with cylinder bores 16.

A lower portion of the lower partition wall 15L is formed as a bottom wall 15L1 of the crank chamber 17. A crankshaft 18 extending in the lateral direction of the vehicle is rotatably supported to the upper and lower crankcases 2 and 3 in such a manner that the axis of rotation of the crankshaft 18 lies on the plane where the lower end surface of the upper crankcase 2 is mated to the upper end surface of the lower crankcase 3. A plurality of pistons 19 composed of three front pistons and two rear pistons are connected through connecting rods 21 to the crankshaft 18.

An oil pan 25 is connected to the lower end surface of the lower crankcase 3. A space defined in the crankcase R on the rear side and lower side of the partition wall 15 and a space defined in the oil pan 25 are contiguous to each other. The space on the rear side of the partition wall 15 functions as a transmission chamber 26, in which a multiplate friction clutch (not shown) and a constant mesh gear transmission 28 are accommodated. That is, the transmission chamber 26 contains a main shaft 29, a counter shaft 30, a shift drum 31, and fork support shafts 32 and 33, all of which extending in the lateral direction of the vehicle.

The main shaft 29 of the transmission 28 is driven through a gear provided on an end portion of the crankshaft 18 projecting outside of a side support wall of the crank chamber 17 and through the multiplate friction clutch. Six gears are provided on each of the main shaft 29 and the counter shaft 30 to constitute the transmission 28.

Forks 34 and 35 for moving the axially movable gears provided on the main shaft 29 and the counter shaft 30 are supported to the fork support shafts 32 and 33, respectively. A pin projects from a boss portion of each of the forks 34 and 35 and engages with a groove formed on the shift drum 31. The forks 34 and 35 are axially driven through the respective pins.

An oil pump unit 40 is provided in the space on the lower side of the partition wall 15. An oil inlet pipe 43 and a strainer 44 are provided so as to extend from the lower surface of the oil pump unit 40 to a lower portion of the oil pan 25. The oil pump unit 40 is composed of a scavenging pump 41 and a feed pump 42 using a common pump shaft 80 (FIG. 15) driven through a chain by the main shaft 29 of the transmission 28.

In FIG. 1, the scavenging pump 41 is provided behind the feed pump 42 in the lateral direction of the vehicle. An oil filter 46 and a water-cooled oil cooler 47 are provided at a front portion of the lower crankcase 3. The operation and oil passages of the oil pump unit 40 will be hereinafter described in detail.

Figure 2:
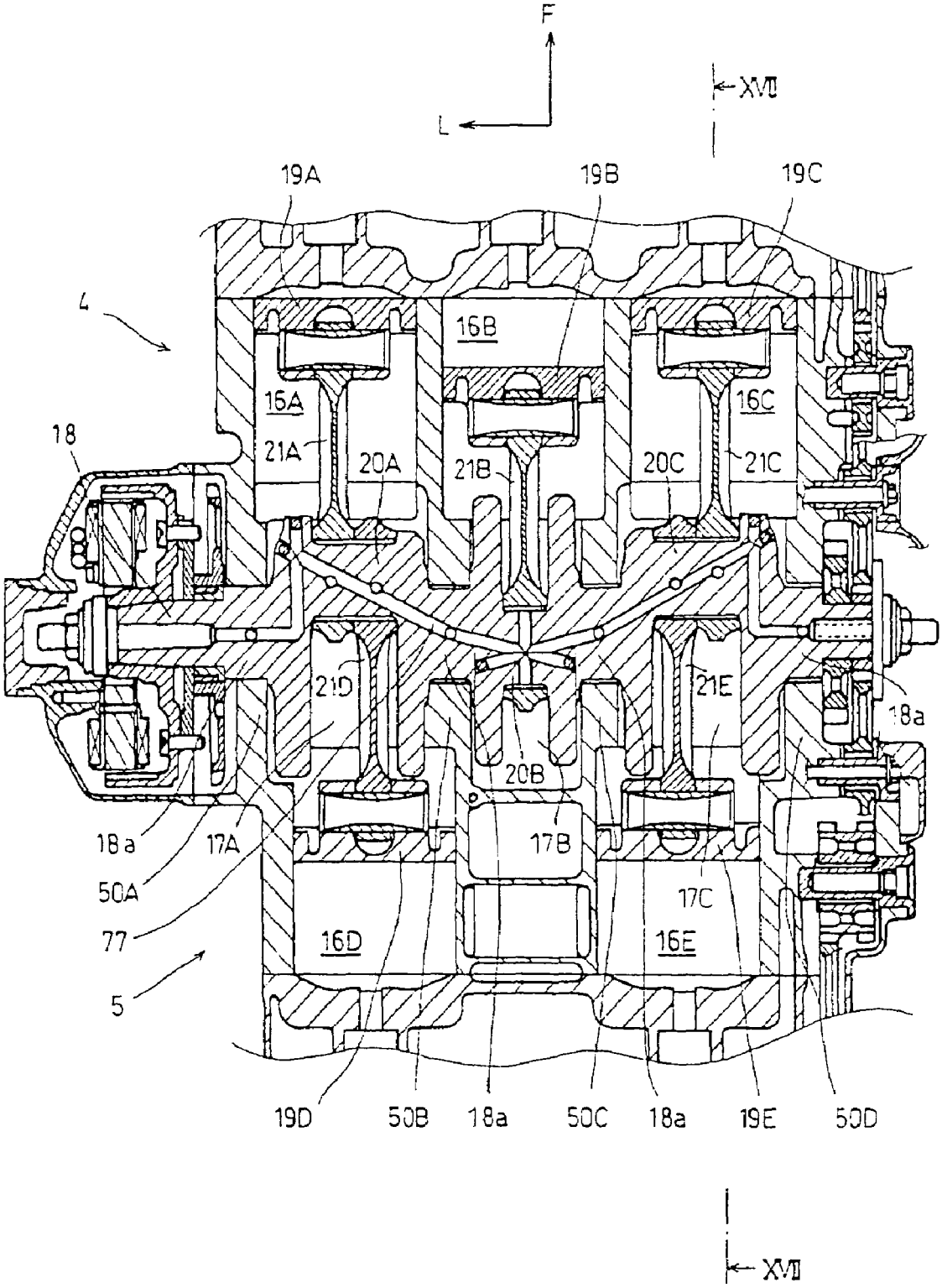
FIG. 2 is a cross section taken along the line II—II in FIG. 1.

FIG. 2 is a cross section taken along the line II—II in FIG. 1. In FIG. 2, the arrows F and L indicate the front side and left side of the engine 1, respectively, when it is mounted on the vehicle. The same applies to the other drawings. The upper half of FIG. 2 shows the front cylinder block 4, and the lower half of FIG. 2 shows the rear cylinder block 5.

The front cylinder block 4 has three cylinder bores 16A, 16B, and 16C, in which pistons 19A, 19B, and 19C are reciprocatably fitted, respectively. The rear cylinder block 5 has two cylinder bores 16D and 16E, in which pistons 19D and 19E are reciprocatably fitted, respectively.

The crankshaft 18 has three crankpins 20A, 20B, and 20C. The pistons 19A and 19D are connected through connecting rods 21A and 21D to the left crankpin 20A of the crankshaft 18, respectively. The piston 19B is connected through a connecting rod 21B to the central crankpin 20B of the crankshaft 18. The pistons 19C and 19E are connected through connecting rods 21C and 21E to the right crankpin 20C of the crankshaft 18.

The crankshaft 18 has a plurality of (four in this preferred embodiment) journal portions 18*a* supported to bearing portions 52 formed on a plurality of (four in this preferred embodiment) crankshaft support walls 50A, 51A; 50B, 51B; 50C, 51C; and 50D, 51D (FIGS. 4 and 5) to be hereinafter described. In FIG. 2, the sectional surfaces of the four upper support walls 50A, 50B, 50C, and 50D formed in the upper crankcase 2 are shown.

Figure 3:
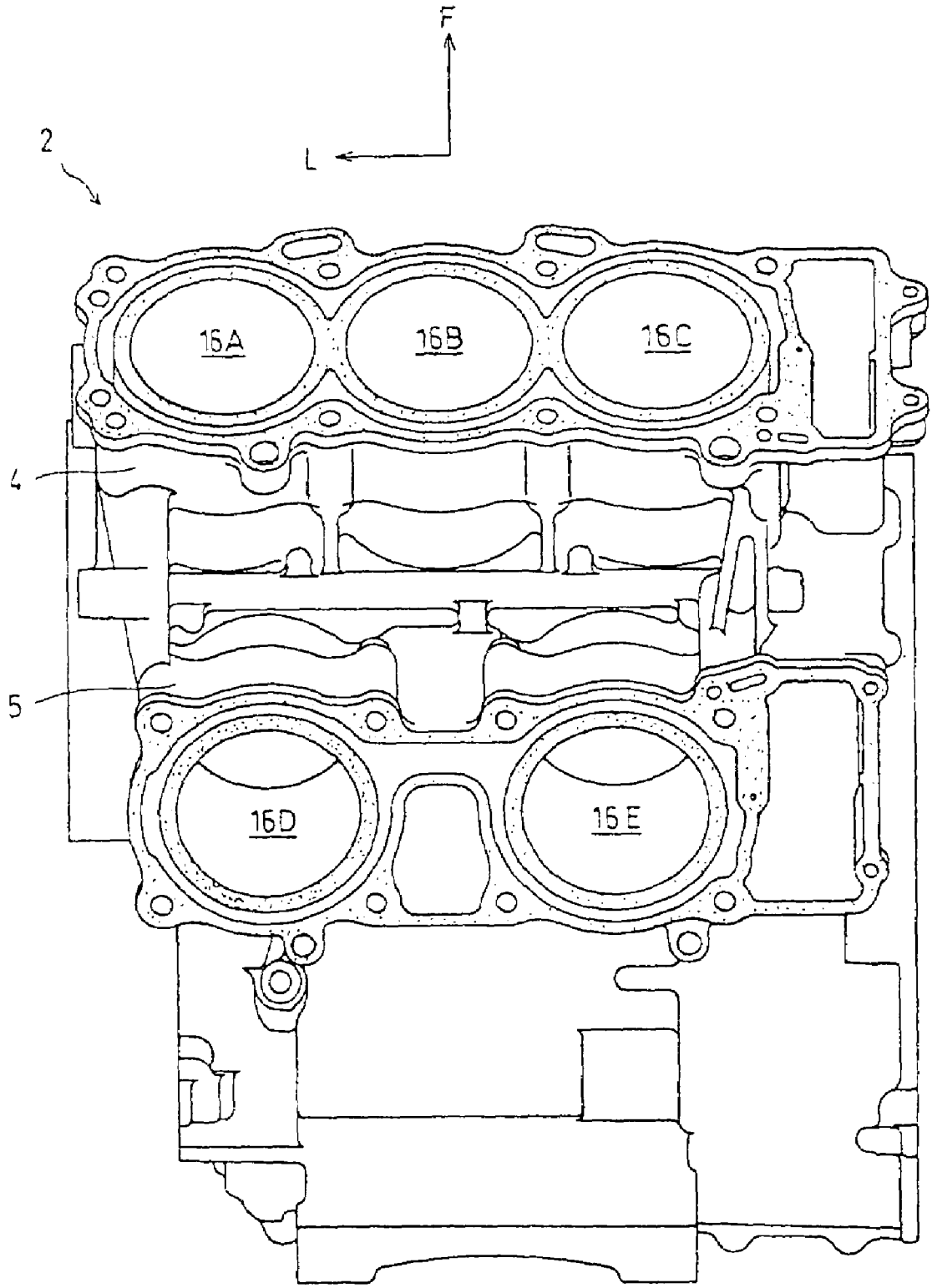
FIG. 3 is a top plan view of the upper crankcase.

FIG. 3 is a top plan view of the upper crankcase 2. As shown in FIG. 3, the three cylinder bores 16A, 16B, and 16C of the front cylinder block 4 are arranged in adjacent relationship with each other in the axial direction of the crankshaft 18 (which direction will be hereinafter referred to also as "crank axial direction"), and the two cylinder bores 16D and 16E of the rear cylinder block 5 are arranged in spaced relationship with each other in the axial direction of the crankshaft 18.

Figure 4:
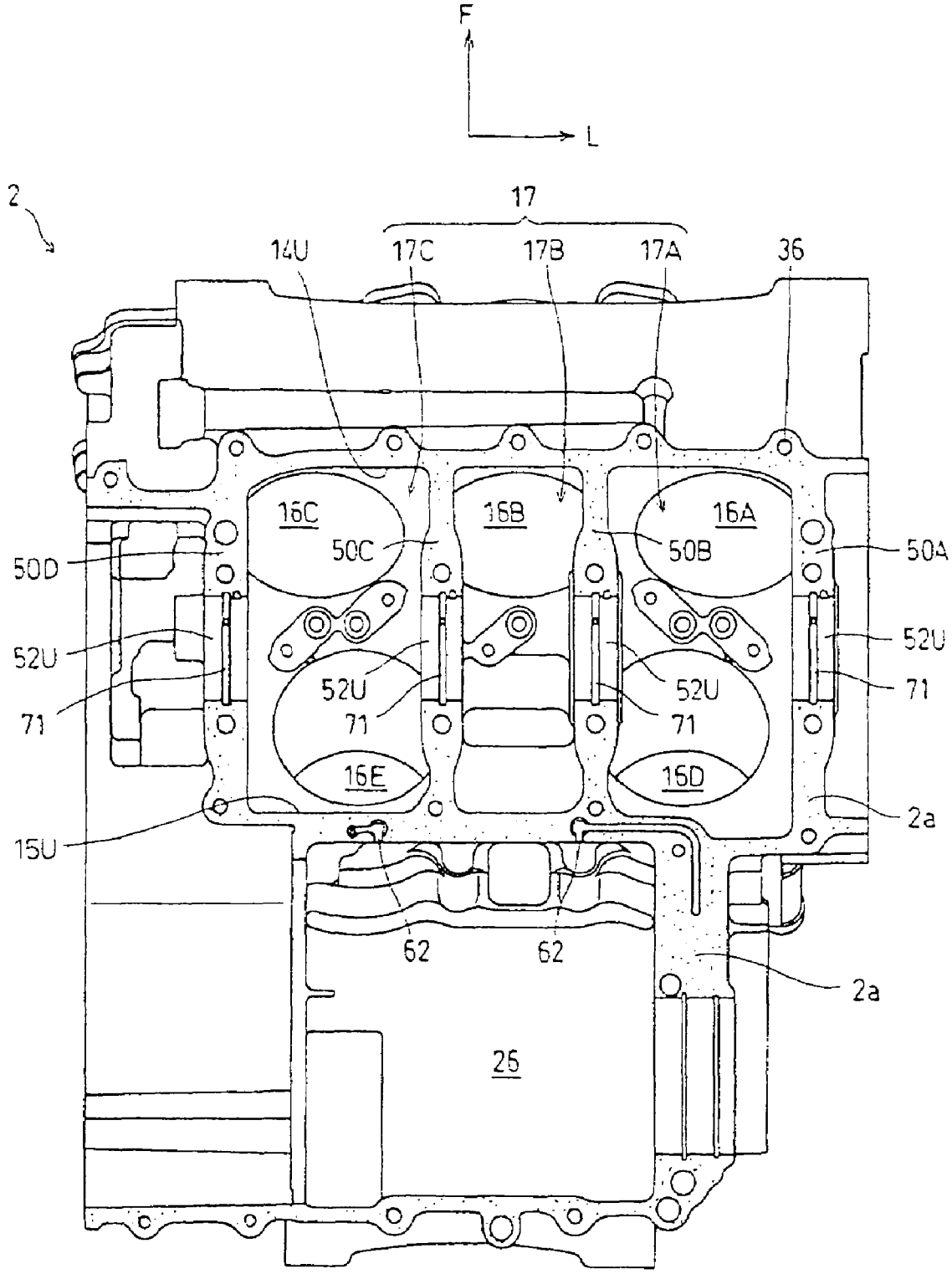
FIG. 4 is a bottom plan view of the upper crankcase.

FIG. 4 is a bottom plan view of the upper crankcase 2. The lower end surface of the upper crankcase 2 is a mating surface 2*a* to be mated to the upper end surface of the lower crankcase 3. As shown in FIG. 4, the upper half of the crank chamber 17 is surrounded by the front half of the mating surface 2*a* of the upper crankcase 2, and the upper half of the transmission chamber 26 is surrounded by the rear half of the mating surface 2*a* of the upper crankcase 2. The upper half of the crank chamber 17 is isolated on the front and rear sides by a front wall 14U and an upper partition wall 15U of the upper crankcase 2, and is partitioned in the lateral direction by the four upper support walls 50A, 50B, 50C, and 50D of the upper crankcase 2, thereby defining three isolated spaces. Four recesses 52U functioning as the bearing portions 52 for respectively supporting the journal portions 18*a* (FIG. 2) of the crankshaft 18 are formed at central portions of the upper support walls 50A, 50B, 50C, and 50D.

Figure 5:
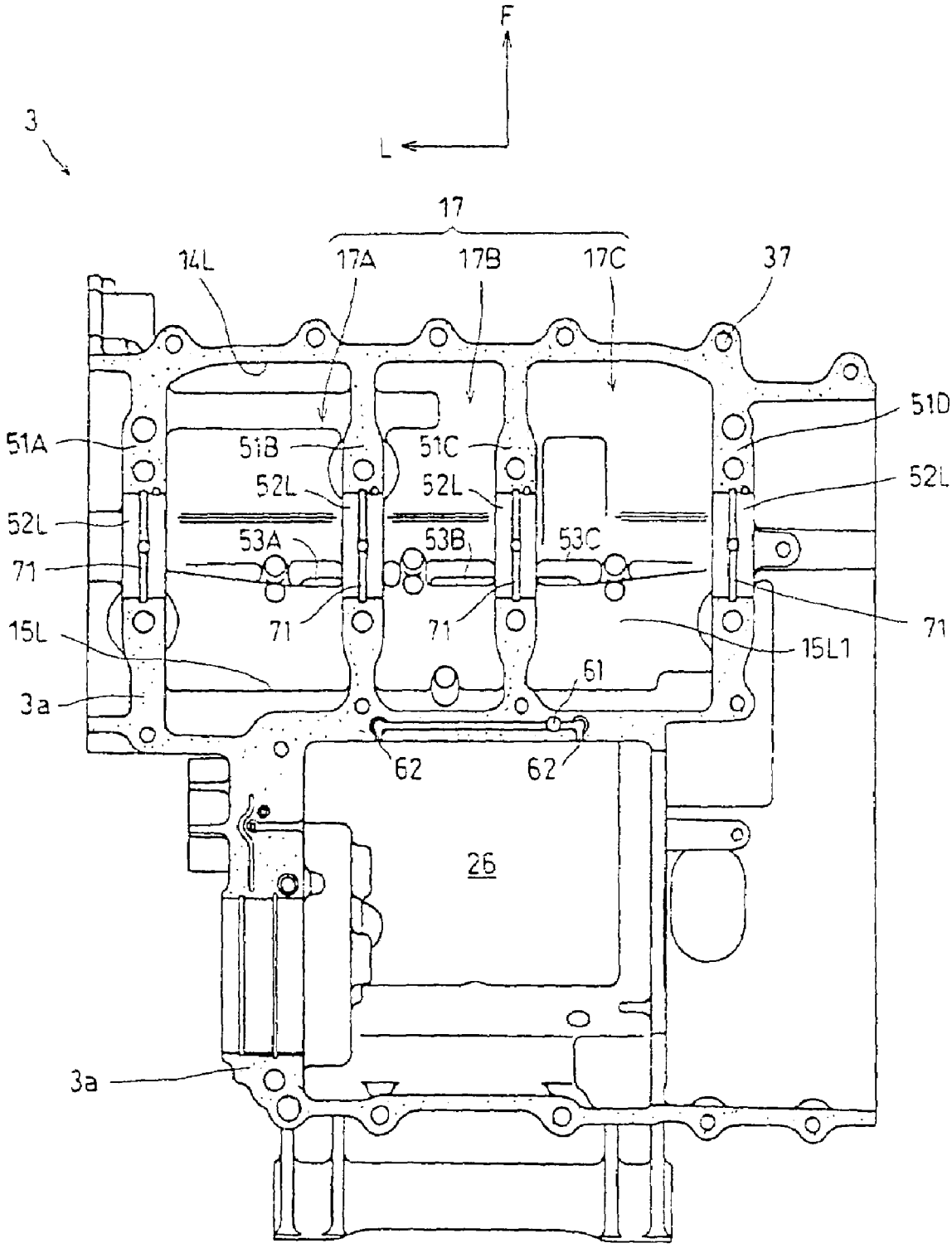
FIG. 5 is a top plan view of the lower crankcase.

FIG. 5 is a top plan view of the lower crankcase 3. The upper end surface of the lower crankcase 3 is a mating surface 3*a* to be mated to the mating surface 2*a* of the upper crankcase 2. As shown in FIG. 5, the lower half of the crank chamber 17 is surrounded by the front half of the mating surface 3*a* of the lower crankcase 3, and the lower half of the transmission chamber 26 is surrounded by the rear half of the mating surface 3*a* of the lower crankcase 3.

The lower half of the crank chamber 17 is isolated on the front and rear sides by a front wall 14L and a lower partition wall 15L of the lower crankcase 3, and is partitioned in the lateral direction by four lower support walls 51A, 51B, 51C, and 51D of the lower crankcase 3, thereby defining three isolated spaces. Four recesses 52L functioning as the bearing portions 52 for respectively supporting the journal portions 18*a* of the crankshaft 18 are formed at central portions of the lower support walls 51A, 51B, 51C, and 51D.

When the mating surfaces 2*a* and 3*a* of the upper crankcase 2 (FIG. 4) and the lower crankcase 3 (FIG. 5) are mated to each other, the recesses 52U and the respectively corresponding recesses 52L of the crankshaft support walls 50A, 51A; 50B, 51B; 50C, 51C; and 50D, 51D form the four bearing portions 52 for rotatably supporting the journal portions 18*a* (FIG. 2) of the crankshaft 18. Further, the three isolated spaces of the upper crankcase 2 respectively communicate with the three isolated spaces of the lower crankcase 3 to thereby define a plurality of or a predetermined number of (three in this preferred embodiment) isolated crank chambers 17A, 17B, and 17C (see also FIG. 2).

These isolated crank chambers 17A, 17B, and 17C are substantially closed crank chambers not communicating with each other. As shown in FIG. 5, the bottom wall 15L1 of the crank chamber 17 is formed with oil outlet holes 53A, 53B, and 53C respectively communicating with the isolated crank chambers 17A, 17B, and 17C. The upper crankcase 2 and the lower crankcase 3 are connected together by inserting bolts through a plurality of through holes 37 formed along the outer periphery of the lower crankcase 3 (FIG. 5) and threadedly engaging the bolts with a plurality of tapped holes 36 formed along the outer periphery of the upper crankcase 2 (FIG. 4).

Figure 6:
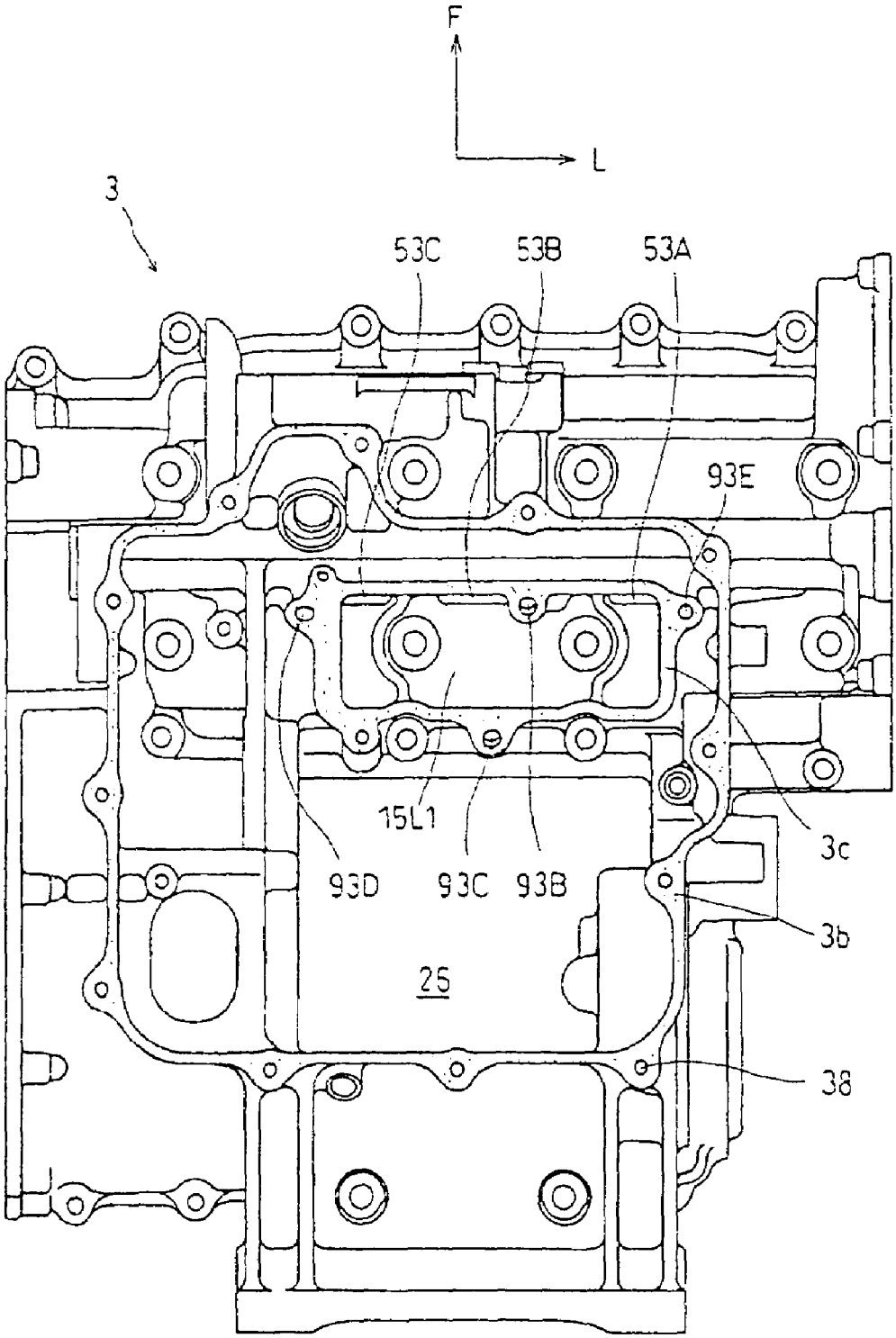
FIG. 6 is a bottom plan view of the lower crankcase.

FIG. 6 is a bottom plan view of the lower crankcase 3. The lower portion of the lower crankcase 3 is formed with an oil pan abutting surface 3*b* to which the oil pan 25 is connected.

The oil pan 25 is connected to the oil pan abutting surface 3*b* of the lower crankcase 3 by inserting bolts through a plurality of through holes formed along the outer periphery of the upper end surface of the oil pan 25 and threadedly engaging the bolts with a plurality of tapped holes 38 formed along the outer periphery of the lower end surface of the lower crankcase 3.

As shown in FIG. 6, a small-sized abutting surface is provided inside the oil pan abutting surface 3*b*. This abutting surface is an abutting surface 3*c* to which a crank chamber oil collecting pan 55 (to be hereinafter described) is connected. The abutting surface 3*c* is formed on the bottom wall 15L1 serving also as the bottom walls of the isolated crank chambers 17A, 17B, and 17C. The oil outlet holes 53A, 53B, and 53C are shown inside the crank chamber oil collecting pan abutting surface 3*c* of the lower crankcase 3. The crank chamber oil collecting pan 55 functions to collect oils separately flowing from the oil outlet holes 53A, 53B, and 53C and to supply the collected oil to an inlet port 41*a* of the scavenging pump 41. The space defined on the rear side of the crank chamber oil collecting pan abutting surface 3*c* and inside the oil pan abutting surface 3*b* is the transmission chamber 26.

Figure 7:
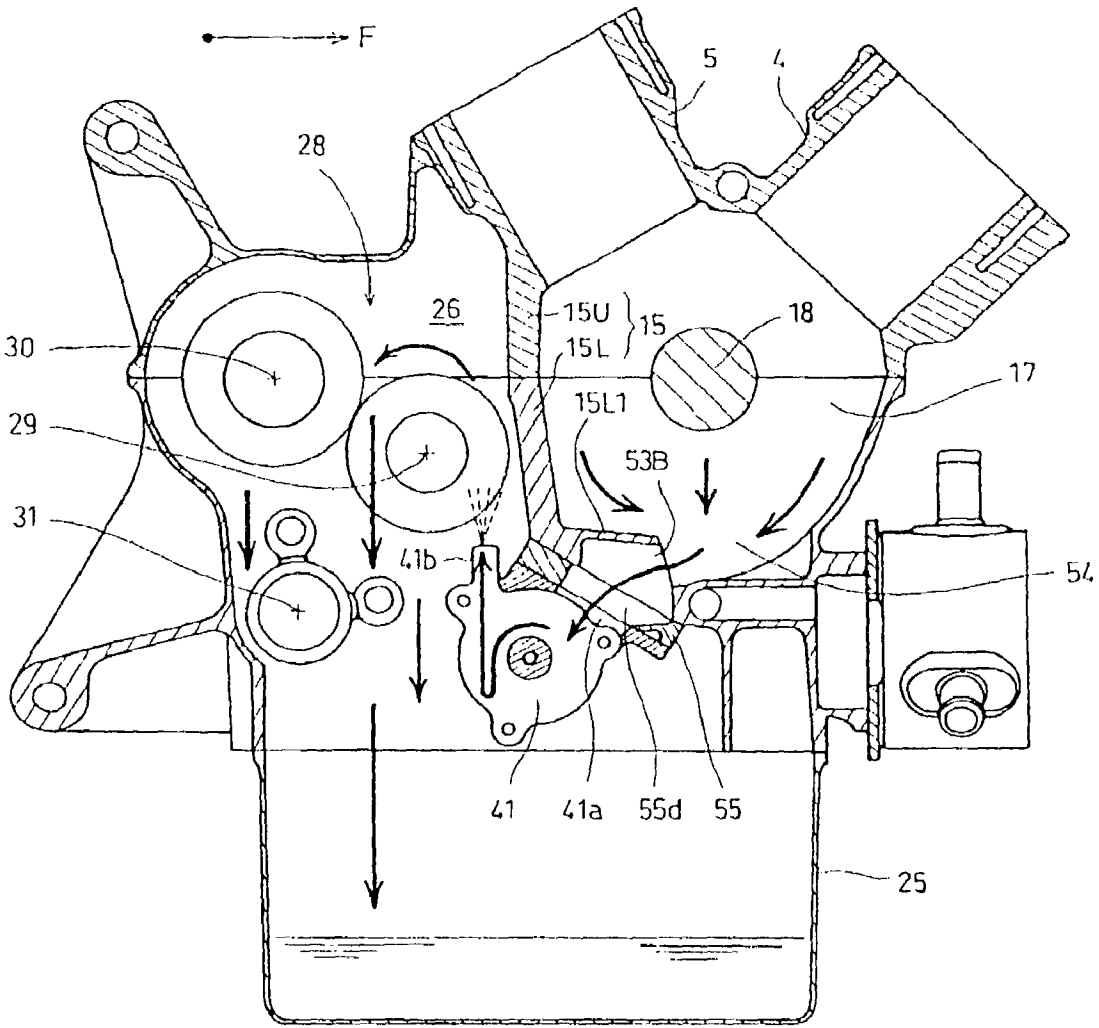
FIG. 7 is a sectional view illustrating the inlet and outlet paths for oil from the crank chamber by the scavenging pump.

FIG. 7 is a sectional view illustrating the inlet and outlet paths for oil from the crank chamber 17 by the scavenging pump 41. The feed pump 42, the oil inlet pipe 43, the strainer 44, the oil outlet pipe 45, and the oil filter 46 (all being shown in FIG. 1) provided on the right side of the scavenging pump 41 in the lateral direction of the vehicle are not shown in FIG. 7, but only the scavenging pump 41 of the oil pump unit 40 and a part of the crank chamber 17 near the scavenging pump 41 are shown in FIG. 7.

That is, the oil outlet hole 53B (one of the three oil outlet holes 53A, 53B, and 53C) formed at the bottom wall 15L1 of the crank chamber 17 is shown in FIG. 7. The oil collecting pan 55 is connected to the bottom wall 15L1 of the crank chamber 17, and the scavenging pump 41 is connected to the lower surface of the oil collecting pan 55.

When the engine 1 is operated, the oils that have lubricated necessary portions in the engine 1 flow down from the upper portions of the isolated crank chambers 17A, 17B, and 17C and are collected at oil storing portions 54 formed at the bottom portions of the isolated crank chambers 17A, 17B, and 17C. These oils collected at the oil storing portions 54 separately flow from the oil outlet holes 53A, 53B, and 53C of the isolated crank chambers 17A, 17B, and 17C, and are next collected together by the oil collecting pan 55. The oil thus collected is drawn into the scavenging pump 41 from its inlet port 41*a* connected to an oil outlet opening 55*d* of the oil collecting pan 55.

The oil that has entered the scavenging pump 41 is moved around the pump shaft 80 (FIG. 15) by the rotation of rotors in the scavenging pump 41, and is next injected upward from an outlet port 41*b*. The fifth-speed and sixth-speed gears on the main shaft 29 of the transmission 28 are located above the outlet port 41*b* of the scavenging pump 41. Since the loads on these gears are large, these gears are especially lubricated by the oil injected from the outlet port 41*b*.

The other gears, the forks 34 and 35 (FIG. 1), and the shift drum 31 of the transmission 28 are lubricated by an oil splash from the fifth-speed and sixth-speed gears. The oil that has lubricated these gears and other necessary portions of the transmission 28 falls down to be stored into the oil pan 25. The arrows shown in FIG. 7 indicate oil paths formed according to the operation of the scavenging pump 41.

Figure 8:
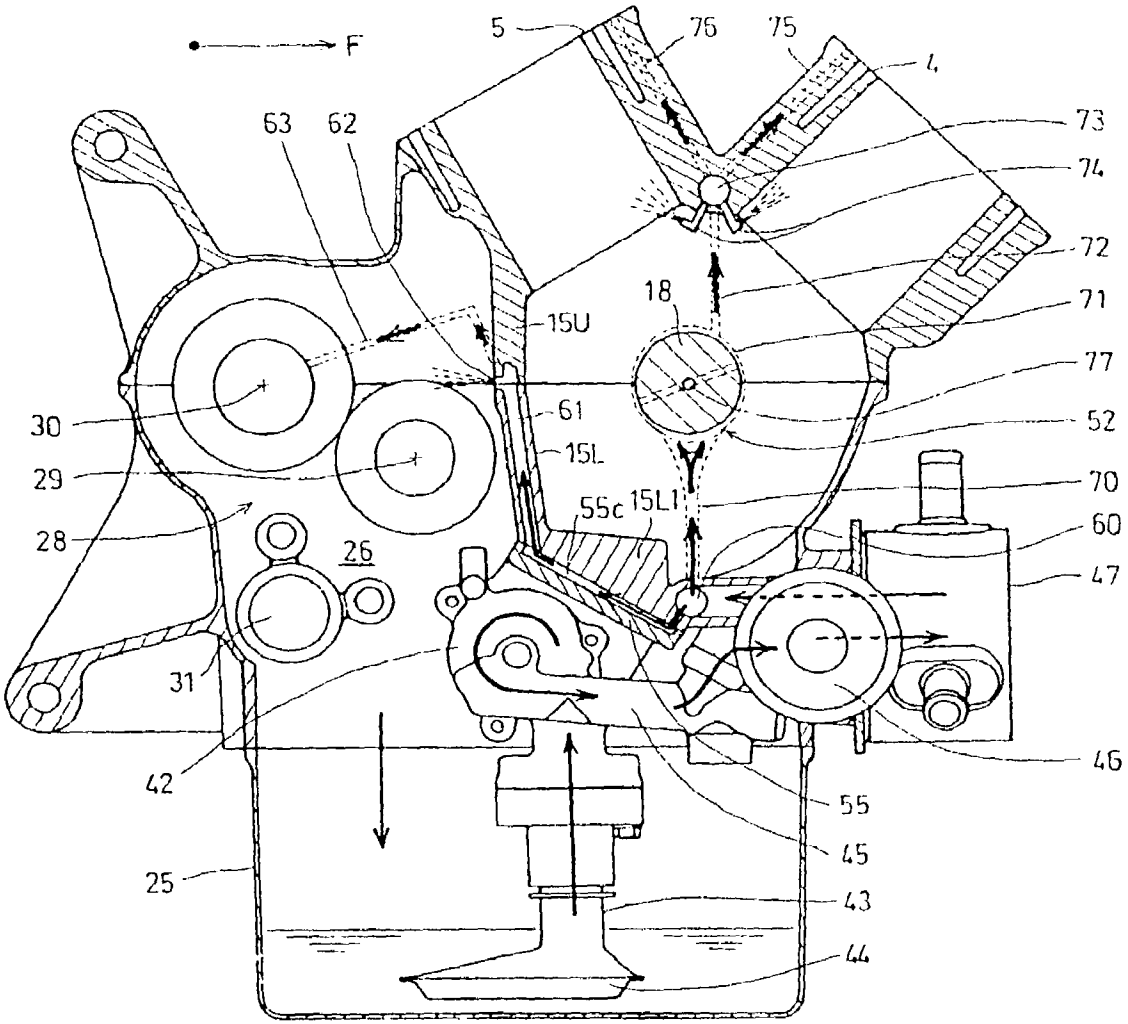
FIG. 8 is a sectional view illustrating the raising of oil from the oil pan by the feed pump, the discharging of oil from the feed pump, and oil paths to necessary portions to be lubricated.

FIG. 8 is a sectional view illustrating the raising of oil from the oil pan 25 by the feed pump 42, the discharging of oil from the feed pump 42, and oil paths to necessary portions to be lubricated. In FIG. 8, the feed pump 42, the oil inlet pipe 43, the strainer 44, the oil outlet pipe 45, and the oil filter 46 are shown. The scavenging pump 41 is not shown because it is located behind the feed pump 42.

The oil inlet pipe 43 extends from an oil inlet portion of the feed pump 42 toward the bottom of the oil pan 25. A large-diameter portion is formed at the lower end of the oil inlet pipe 43, and the strainer 44 is mounted on the large-diameter portion of the oil inlet pipe 43. An oil inlet port opens to the lower surface of the strainer 44. The oil outlet pipe 45 extends from an oil outlet portion of the feed pump 42, and is connected to the oil filter 46.

Further, an oil passage from the oil filter 46 is directed through the water-cooled oil cooler 47 to a main gallery 60. The oil raised from the oil pan 25 through the strainer 44 and the oil inlet pipe 43 into the feed pump 42 is moved around the pump shaft 80 (FIG. 15) by the rotation of rotors in the feed pump 42, and is discharged from the oil outlet pipe 45. The oil thus discharged is fed through the oil filter 46 and the oil cooler 47 to the main gallery 60.

The oil fed to the main gallery 60 is divided into first and second oils to be fed in two directions. The first oil is fed through an oil groove 55*c* formed on the upper surface of the oil collecting pan 55 at its side edge portion (to be hereinafter described in detail) to a lower partition oil passage 61 formed in the lower partition wall 15L of the lower crankcase 3.

A part of the oil fed upward through the lower partition oil passage 61 is injected from nozzles 62 (FIGS. 8, 4, and 5) to the fifth-speed and sixth-speed gears, and the remaining part of the oil is fed through an oil passage 63 (FIG. 8) formed in the side wall of the transmission chamber 26 to the bearing portions for the main shaft 29 and the counter shaft 30.

The second oil from the main gallery 60 is fed through oil passages 70 respectively formed in the four lower support walls 51A, 51B, 51C, and 51D of the lower crankcase 3 intersecting the main gallery 60 to inner circumferential grooves 71 formed on the bearing portions 52 for the crankshaft 18, thereby lubricating the journal portions 18*a* of the crankshaft 18. The oil is further fed from the inner circumferential grooves 71 through oil passages 72 respectively formed in the four upper support walls 50A, 50B, 50C, and 50D of the upper crankcase 2 to an upper oil gallery 73.

A part of the oil fed from the upper oil gallery 73 is injected from nozzles 74 communicating with the upper oil gallery 73 toward the lower surfaces of the pistons 19 (FIG. 2) in all the cylinder bores 16, thereby lubricating a contact portion between the small end of each connecting rod 21 and the corresponding piston pin and also lubricating a sliding portion between each cylinder bore 16 and the corresponding piston 19.

The remaining part of the oil fed from the upper oil gallery 73 is fed through oil passages 75 formed in the wall of the front cylinder block 4 and oil passages 76 formed in the wall of the rear cylinder block 5 to the front and rear cylinder heads 6 and 7 (FIG. 1), thereby lubricating all the valve trains 10 and 11. The arrows shown in FIG. 8 indicate oil paths formed according to the operation of the feed pump 42.

Further, an oil passage 77 (FIGS. 2 and 8) is formed in the crankshaft 18 to feed the oil from the inner circumferential grooves 71 (FIG. 8) of the bearing portions 52 to each crankpin 20, thereby lubricating a contact portion between each crankpin 20 and the large end of each connecting rod 21. The oil that has lubricated necessary portions in the crank chamber 17 falls down into the oil collecting pan 55 and is next drawn into the scavenging pump 41. The oil that has lubricated necessary portions in the transmission chamber 26 falls down into the oil pan 25 and is next drawn into the feed pump 42.

Figure 9:
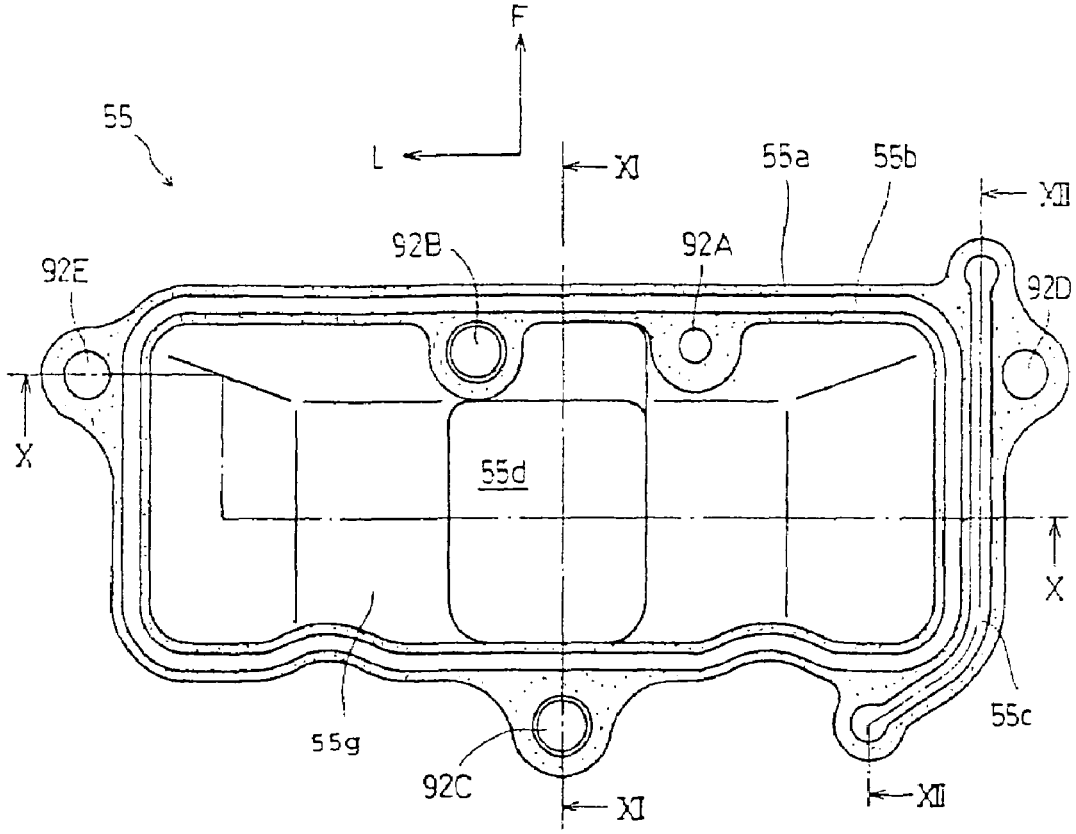
FIG. 9 is a top plan view of the crank chamber oil collecting pan.
Figure 10:
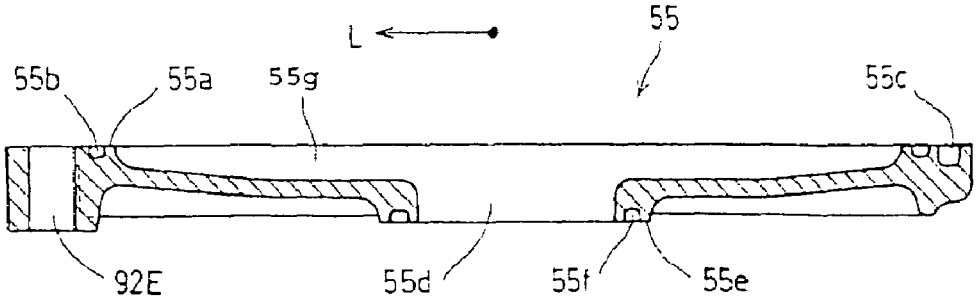
FIG. 10 is a cross section taken along the line X—X in FIG. 9.
Figure 11:
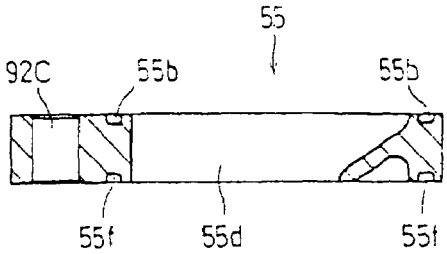
FIG. 11 is a cross section taken along the line XI—XI in FIG. 9.
Figure 12:
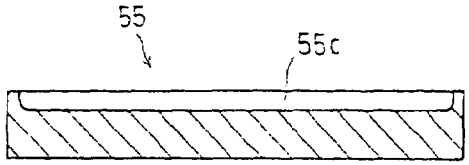
FIG. 12 is a cross section taken along the line XII—XII in FIG. 9.
Figure 13:
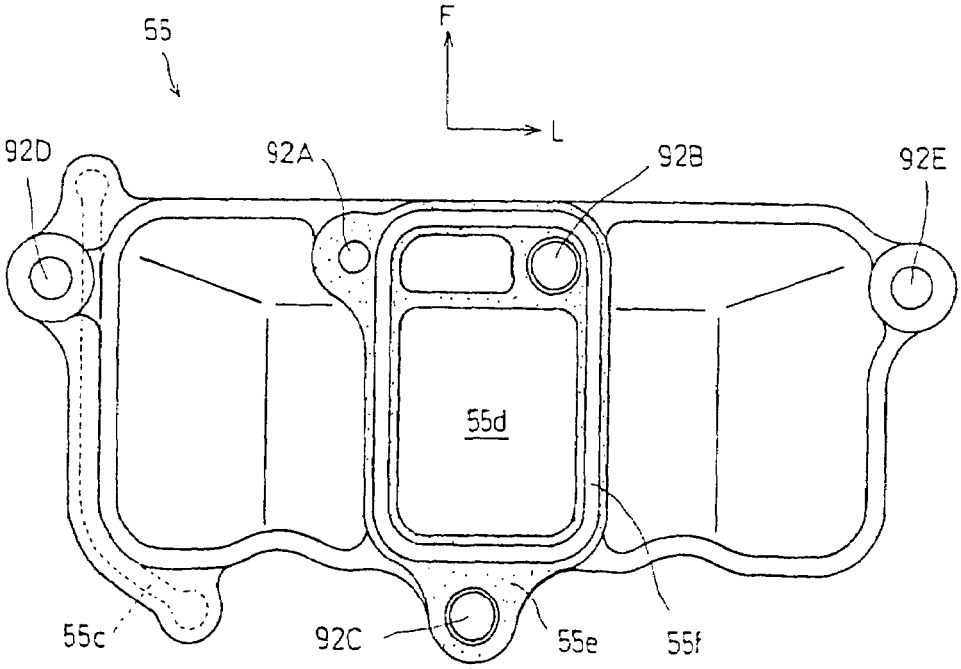
FIG. 13 is a bottom plan view of the oil collecting pan.

FIGS. 9 to 13 are enlarged views of the oil collecting pan 55. More specifically, FIG. 9 is a top plan view of the oil collecting pan 55, FIG. 10 is a cross section taken along the line X—X in FIG. 9, FIG. 11 is a cross section taken along the line XI—XI in FIG. 9, FIG. 12 is a cross section taken along the line XII—XII in FIG. 9, and FIG. 13 is a bottom plan view of the oil collecting pan 55.

The cross section of FIG. 11 is shown in FIG. 7, and the cross section of FIG. 12 is shown in FIG. 8. The oil collecting pan 55 covers all of the three oil outlet holes 53A, 53B, and 53C formed at the bottom wall 15L1 of the crank chamber 17. The oil collecting pan 55 has an upper mount surface 55*a* formed with a packing groove 55*b* in which a packing is mounted. The upper mount surface 55*a* of the oil collecting pan 55 is mounted through the packing in the packing groove 55*b* on the oil collecting pan abutting surface 3*c* of the lower crankcase 3 shown in FIG. 6.

The upper mount surface 55*a* is further formed with an oil groove 55*c* serving as an oil groove for connecting the main gallery 60 and the oil passage 61 of the lower partition wall 15L shown in FIG. 8. As shown in FIG. 10, the oil collecting pan 55 is slightly recessed at a central portion thereof to form a shallow oil reservoir 55*g*. An oil outlet opening 55*d* is formed at the center of this oil reservoir 55*g*. As shown in FIG. 13, a lower mount surface 55*e* is formed around the oil outlet opening 55*d*.

The lower mount surface 55*e* of the oil collecting pan 55 is formed with a packing groove 55*f* in which a packing is mounted. A connection surface 82*a* (FIG. 16) of the scavenging pump 41 is connected through the packing in the packing groove 55*f* to the lower mount surface 55*e* of the oil collecting pan 55.

Figure 14:
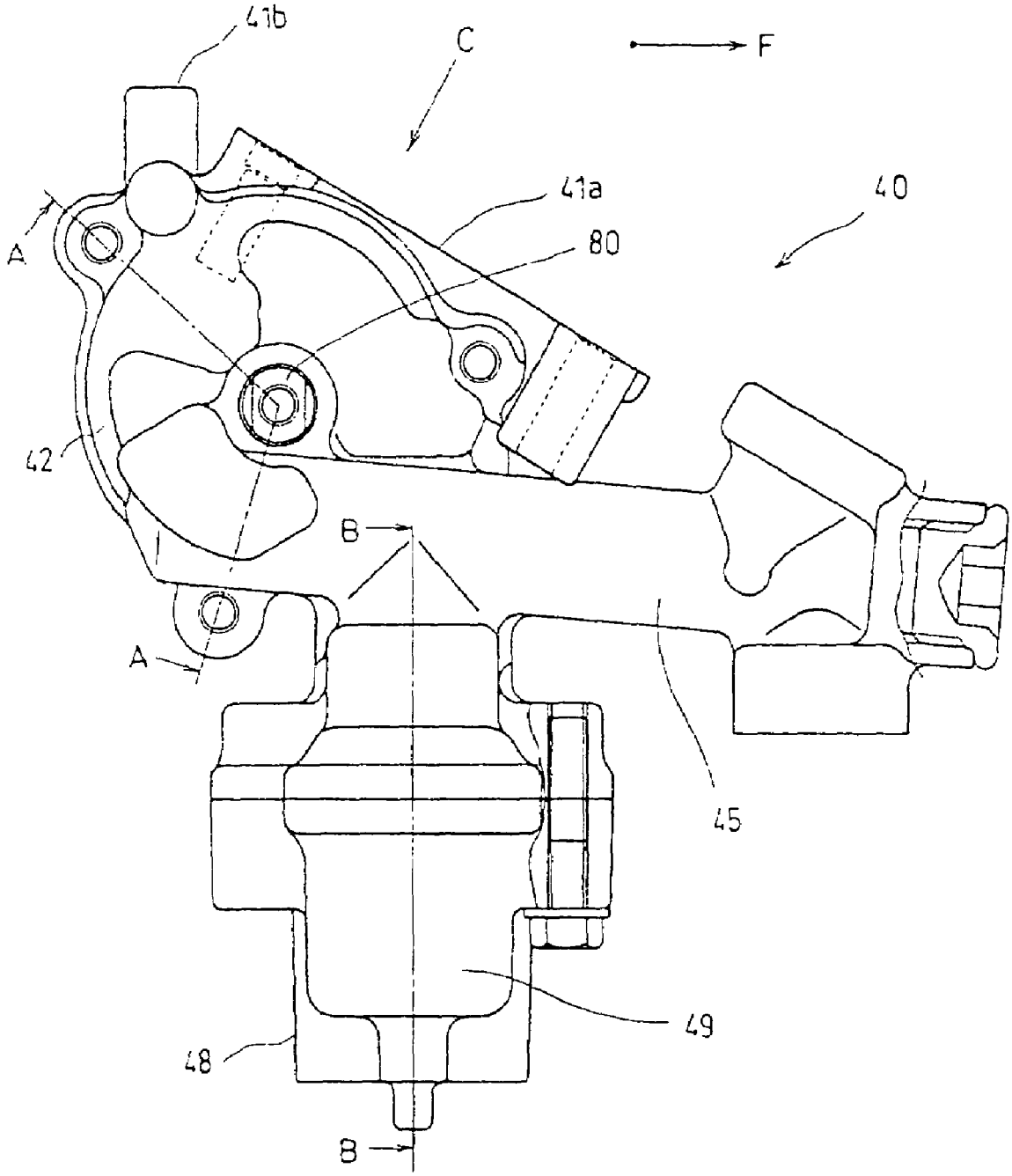
FIG. 14 is a side view of the oil pump unit.
Figure 15:
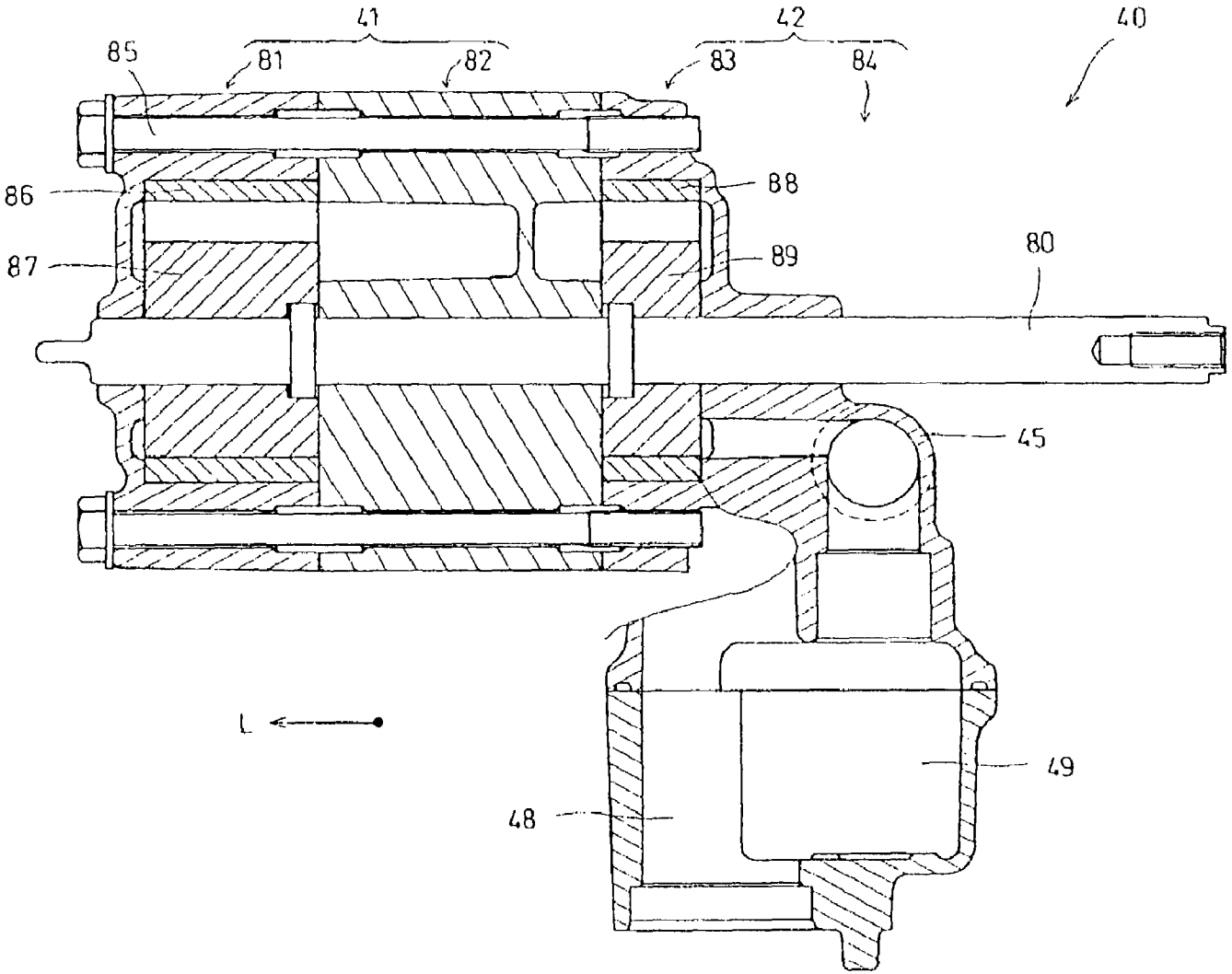
FIG. 15 is a sectional view of the oil pump unit as obtained by combining a cross section taken along the line A—A in FIG. 14 and a cross section taken along the line B—B in FIG. 14.

FIG. 14 is a side view of the oil pump unit 40, and FIG. 15 is a sectional view of the oil pump unit 40. FIG. 15 is the combination of a cross section taken along the line A—A in FIG. 14 and a cross section taken along the line B—B in FIG. 14.

As shown in FIG. 15, the oil pump unit 40 is composed of the scavenging pump 41 and the feed pump 42 to be driven by the common pump shaft 80. Each of the scavenging pump 41 and the feed pump 42 is a trochoid pump. The scavenging pump 41 is composed of a scavenging pump rotor section 81 as a first pump cover and a scavenging pump intake/discharge section 82 as a pump body independent of the rotor section 81.

The feed pump 42 is composed of a feed pump rotor section 83 as a second pump cover and a feed pump intake/discharge section 84 as the second pump cover integral with the rotor section 83. The scavenging pump rotor section 81, the scavenging pump intake/discharge section 82, the feed pump rotor section 83, and the feed pump intake/discharge section 84 are axially arranged in this order from the left side as viewed in FIG. 15 and are connected together by a plurality of bolts 85.

The scavenging pump 41 includes a scavenging pump outer rotor 86 and a scavenging pump inner rotor 87, and the feed pump 42 includes a feed pump outer rotor 88 and a feed pump inner rotor 89. The pump shaft 80 extends through each section of the scavenging pump 41 and the feed pump 42 to rotationally drive the rotors 86 to 89. The pump shaft 80 has an axis of rotation parallel to the axis of rotation of the crankshaft 18, and is driven through a chain by the main shaft 29 (FIG. 1) of the transmission 28. The feed pump intake/discharge section 84 is integrally formed with the oil outlet pipe 45. An oil inlet pipe mounting member 48 and a relief valve storing member 49 are mounted on the feed pump intake/discharge section 84.

Figure 16:
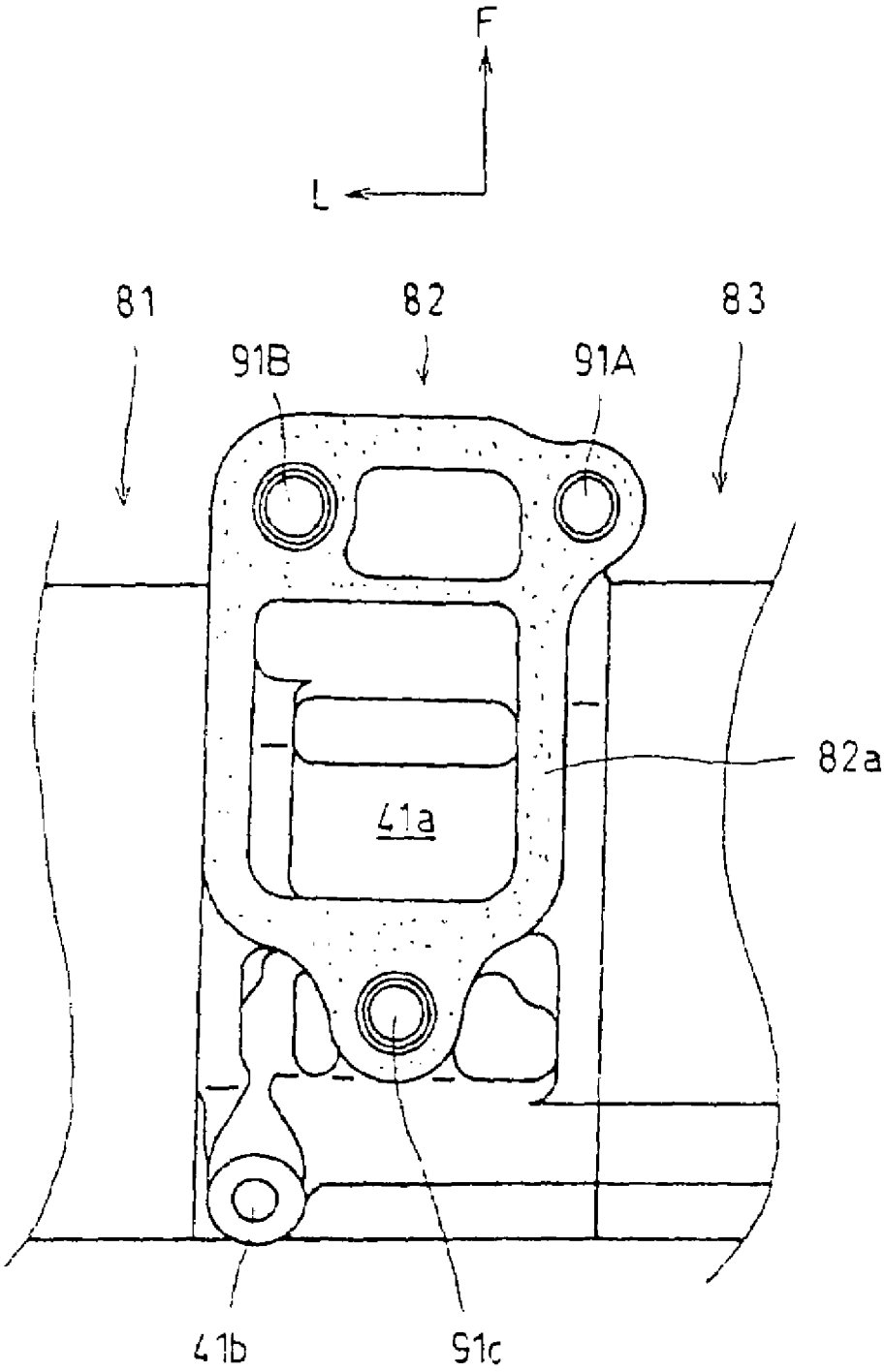
FIG. 16 is a view of a central portion of the oil pump unit taken in the direction of the arrow C in FIG. 14.

FIG. 16 is a view of a central portion of the oil pump unit 40 taken in the direction of the arrow C in FIG. 14. The scavenging pump rotor section 81, the scavenging pump intake/discharge section 82, and the feed pump rotor section 83 are arranged in this order from the left side as viewed in FIG. 16. The scavenging pump intake/discharge section 82 includes the inlet port 41*a* and the outlet port 41*b* shown in FIG. 7. Another outlet port is provided on the right side of the outlet port 41*b* as viewed in FIG. 16, but it is not shown. A pump connection surface 82*a* to be connected to the lower mount surface 55*e* (FIG. 13) of the oil collecting pan 55 is formed around the inlet port 41*a*.

The pump connection surface 82*a* of the oil pump unit 40 shown in FIG. 16 is formed with through holes 91A, 91B, and 91C. On the other hand, the lower mount surface 55*e* of the oil collecting pan 55 shown in FIG. 9 is formed with a tapped hole 92A and through holes 92B and 92C respectively corresponding to the through holes 91A, 91B, and 91C. Further, the lower mount surface 55*e* is formed at its opposite side portions with through holes 92D and 92E.

The oil collecting pan abutting surface 3*c* of the lower crankcase 3 shown in FIG. 6 is formed with tapped holes 93B, 93C, 93D, and 93E respectively corresponding to the through holes 92B, 92C, 92D, and 92E of the oil collecting pan 55. A bolt is inserted through the through hole 91A of the oil pump unit 40 and is threadedly engaged with the tapped hole 92A of the oil collecting pan 55 to fix the oil pump unit 40 to the oil collecting pan 55. Bolts are inserted through the through holes 91B and 91C of the oil pump unit 40 and the through holes 92B and 92C of the oil collecting pan 55 and are threadedly engaged with the tapped holes 93B and 93C of the lower crankcase 3 to fix the oil pump unit 40 and the oil collecting pan 55 to the lower crankcase 3. Further, bolts are inserted through the through holes 92D and 92E of the oil collecting pan 55 and are threadedly engaged with the tapped holes 93D and 93E of the lower crankcase 3 to fix the oil collecting pan 55 to the lower crankcase 3.

According to the above preferred embodiment, the provision of the single scavenging pump 41 is sufficient for drawing the oil discharged from the plural isolated crank chambers 17A, 17B, and 17C, and it is not necessary to provide a plurality of scavenging pumps, thereby reducing the number of parts, simplifying the structure, and reducing the weight of the engine 1. Since the scavenging pump 41 is directly mounted on the oil collecting pan 55, it is not necessary to provide any independent mounting member, thereby reducing the number of parts. Further, the oil collecting pan 55 has the oil groove 55*c* serving as an oil passage for connecting the main gallery 60 and the oil passage 61 of the lower partition wall 15L. Accordingly, the oil staying in the oil passages of the engine 1 can be easily removed in performing maintenance, and the oil passages can be easily cleaned.

Second Preferred Embodiment

A second preferred embodiment of the present invention will now be described with reference to FIGS. 2 and 17 to 20. The second preferred embodiment is improved in discharge efficiency of oil from the isolated crank chamber 17B to a scavenging pump 151 as compared with the first preferred embodiment. The second preferred embodiment is different from the first preferred embodiment in that the structure of a crankcase R, a crank chamber oil collecting pan 120, and an oil pump unit 150 is partially different and that a reed valve 140 is provided. The other configuration is basically the same as that of the first preferred embodiment. Therefore, FIG. 2 is used also in the second preferred embodiment. The description of the same parts as those of the first preferred embodiment will be omitted or simplified, and the different parts will be mainly described. The same or corresponding parts as those of the first preferred embodiment are denoted by the same reference numerals as required.

Figure 17:
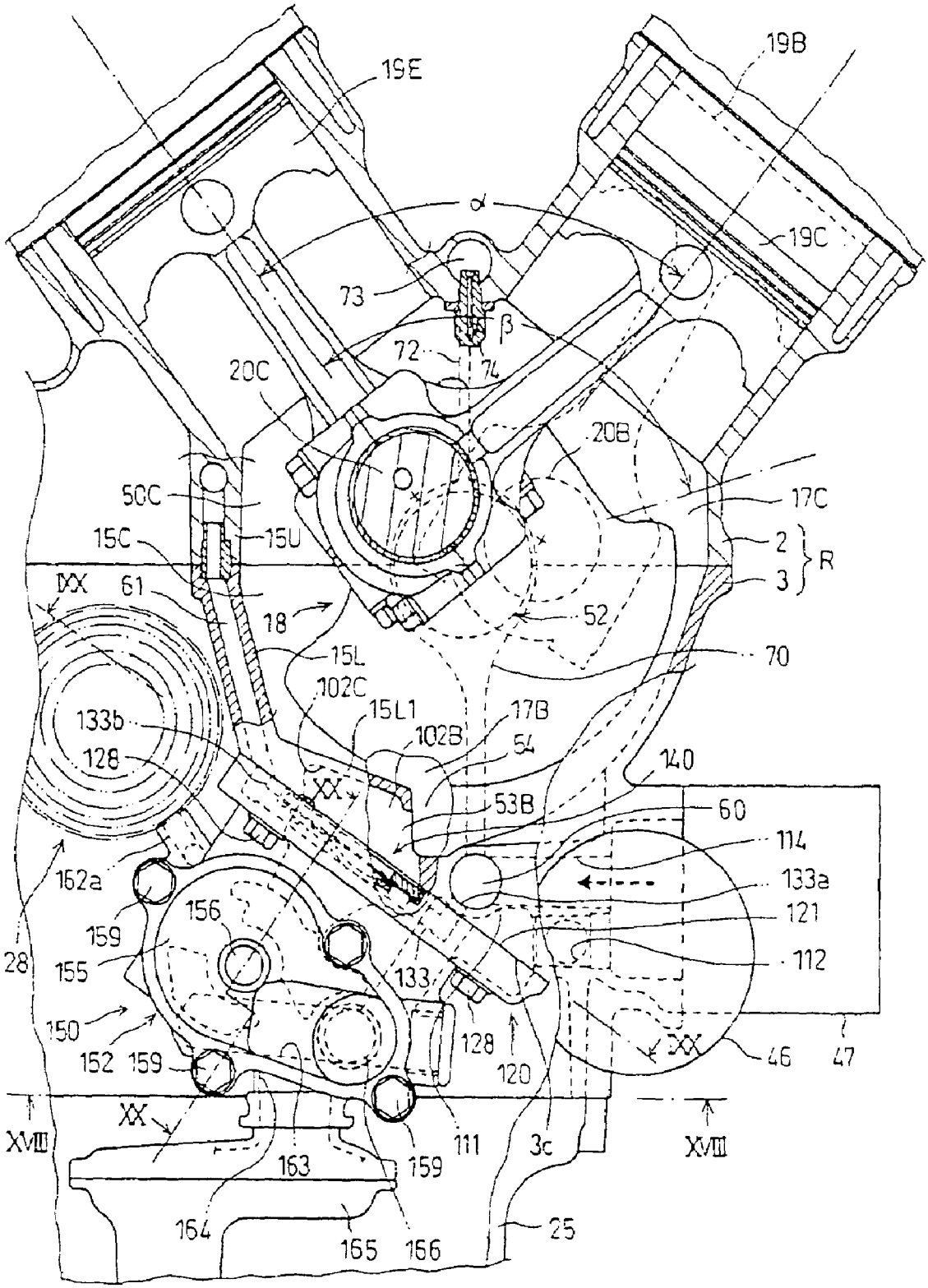
FIG. 17 is a sectional side view of an essential part of the V-type, five-cylinder, four-cycle internal combustion engine according to a second preferred embodiment of the present invention, and it partially corresponds to a cross section taken along the line XVII—XVII in FIG. 2.
Figure 18:
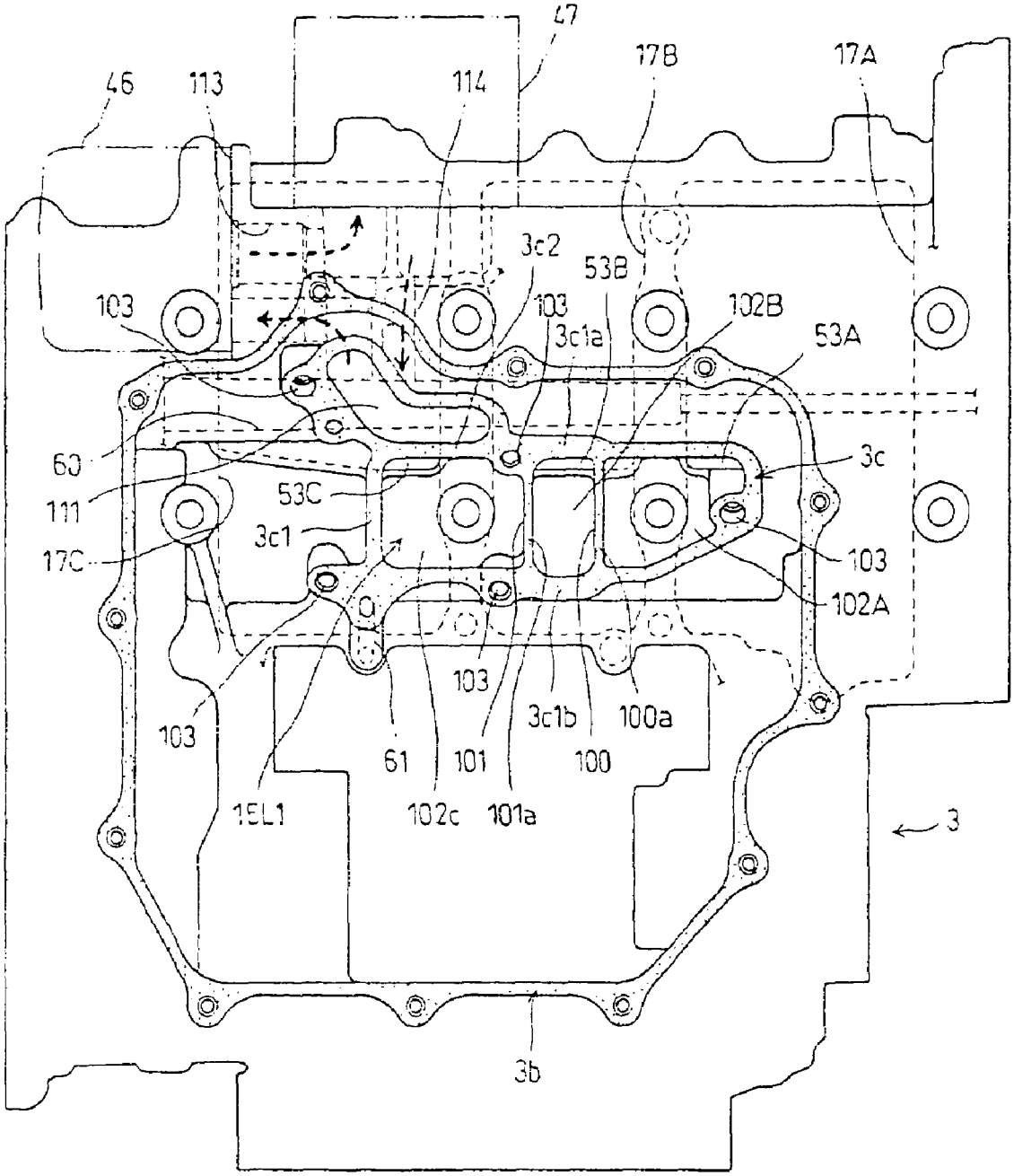
FIG. 18 is a sectional view of an essential part of the crankcase as taken along the line XVIII—XVIII in FIG. 17.
Figure 19A:
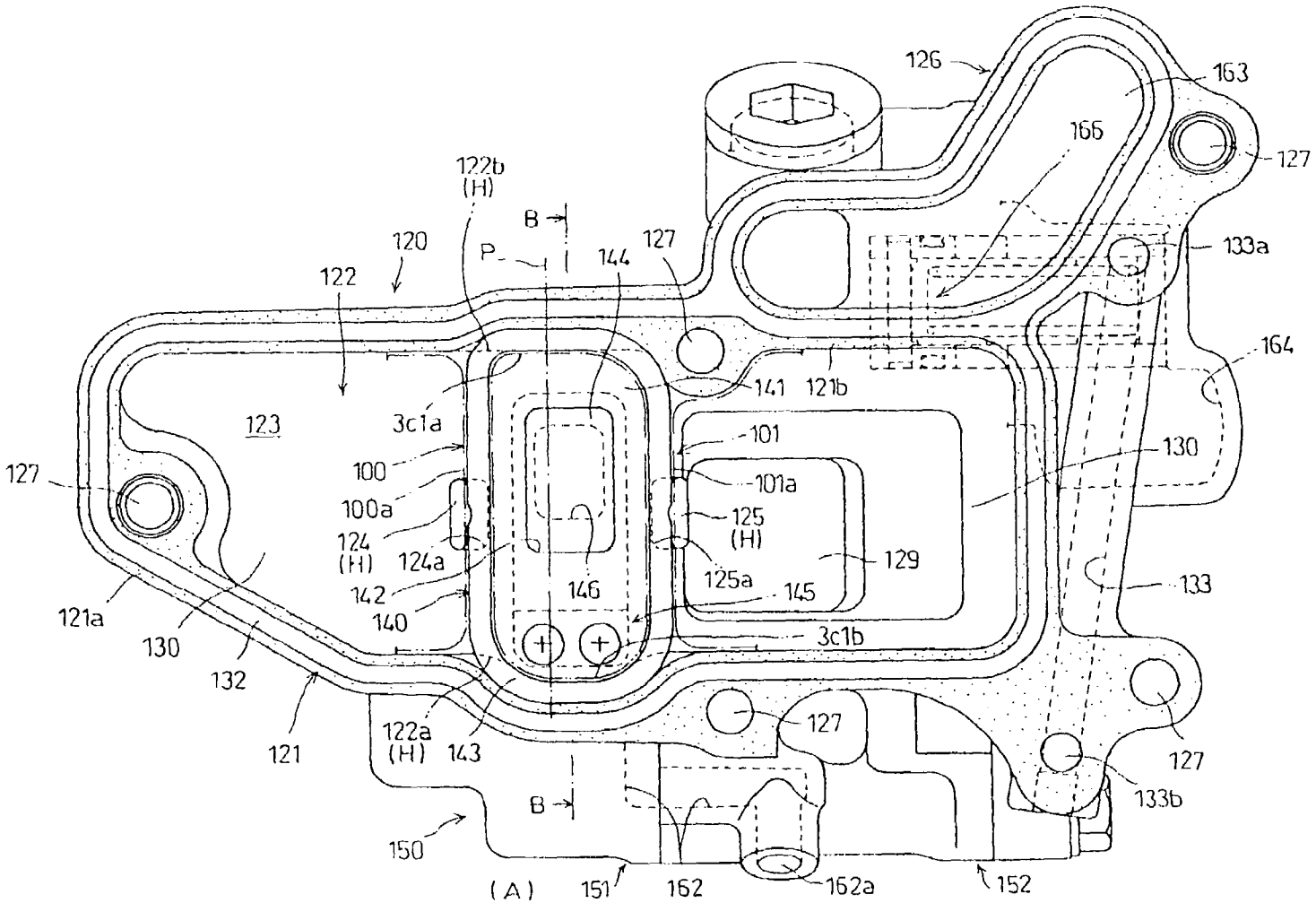
FIG. 19(A) is a sectional view of the oil pump unit as taken along the line IXX—IXX in FIG. 17.
Figure 19B:
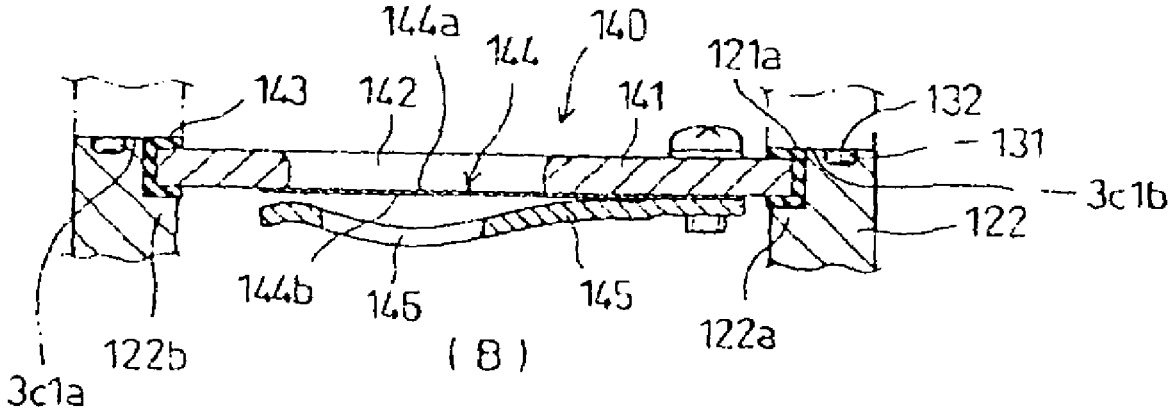
FIG. 19(B) is a cross section taken along the line B—B in FIG. 19(A)
Figure 20:
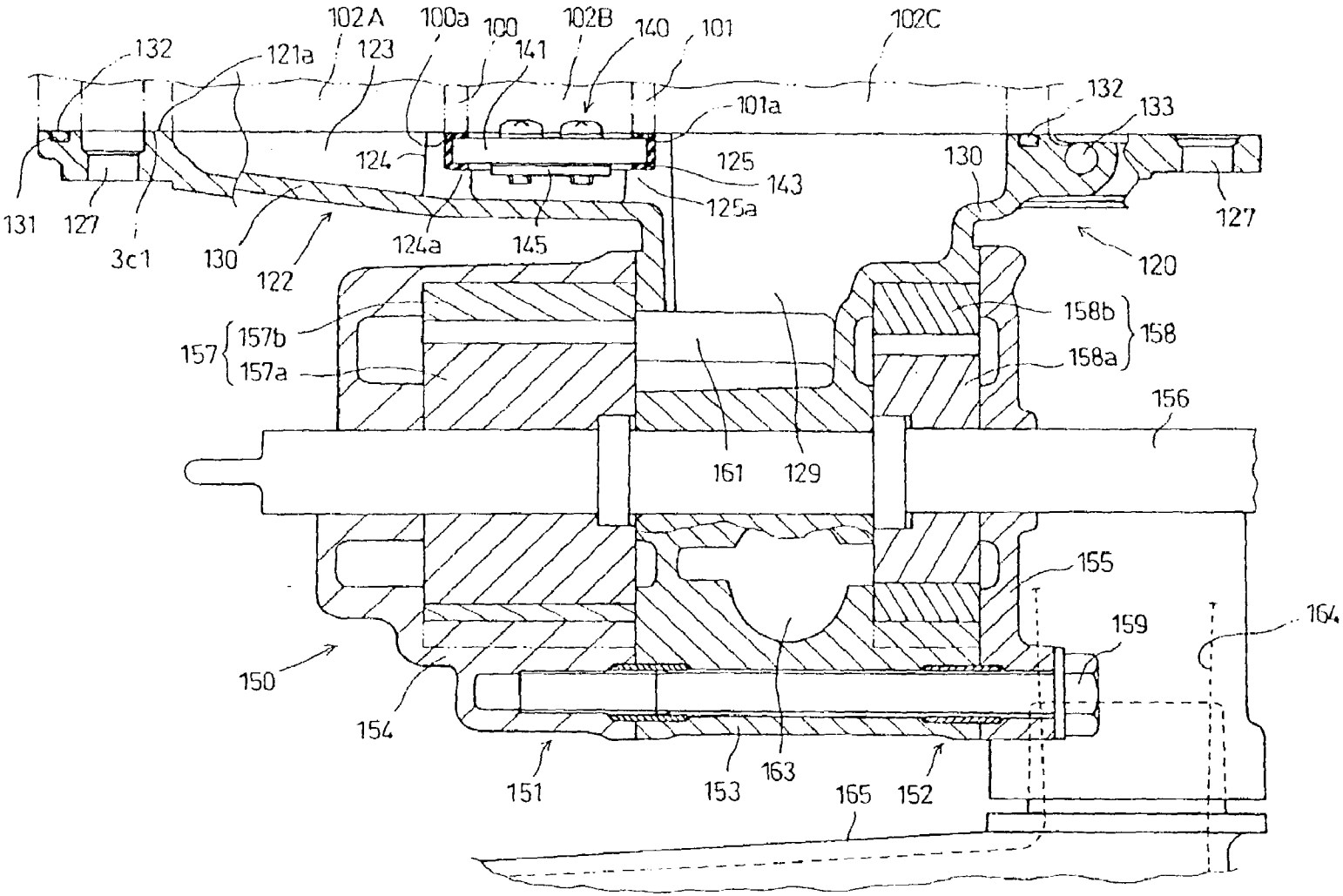
FIG. 20 is a sectional view of the oil pump unit as taken along the line XX—XX in FIG. 17.

FIG. 17 is a sectional side view of an essential part of a V-type, five-cylinder, four-cycle internal combustion engine 1 according to the second preferred embodiment of the present invention, and it partially corresponds to a cross section taken along the line XVII—XVII in FIG. 2. FIG. 18 is a sectional view of an essential part of the crankcase R as taken along the line XVIII—XVIII in FIG. 17. FIG. 19(A) is a sectional view of the oil pump unit 150 as taken along the line IXX—IXX in FIG. 17, and FIG. 19(B) is a cross section taken along the line B—B in FIG. 19(A). FIG. 20 is a sectional view of the oil pump unit 150 as taken along the line XX—XX in FIG. 17.

Referring to FIGS. 2, 17, and 18, the engine 1 includes the crank chamber oil collecting pan 120 mounted on the lower crankcase 3 of the crankcase R, the reed valve 140, and the oil pump unit 150.

As in the first preferred embodiment, the crankshaft 18 rotatably supported to the bearing portions 52 of the crankcase R has three crankpins 20A, 20B, and 20C. The crankpins 20A and 20C are respectively accommodated in the isolated crank chambers 17A and 17C as first isolated crank chambers formed at the opposite ends in the crank axial direction. The rotational position or phase of the crankpin 20A is the same as that of the crankpin 20C. On the other hand, the crankpin 20B is accommodated in the central isolated crank chamber 17B as a second isolated crank chamber, and the phase of the crankpin 20B is different from that of each of the crankpins 20A and 20C with a predetermined phase difference β. The phase difference β is related to the angle α by the following equation:

$$\beta(°)=180-\alpha(°)$$

The pressure in each of the isolated crank chambers 17A, 17B, and 17C varies to a negative pressure during the upward stroke of each piston 19 (the stroke from the bottom dead center to the top dead center of each piston 19) and the downward stroke of each piston 19 (the stroke from the top dead center to the bottom dead center of each piston 19). The minimum value of the pressure in the isolated crank chamber 17B is smaller than that of the pressure in each of the isolated crank chambers 17A and 17C. This is due to the following fact.

Two pistons 19A and 19D different in timing of reaching the top dead center (i.e., in rotational position of the crankshaft 18) are connected to the crankpin 20A as the first crankpin. Similarly, two pistons 19C and 19E different in timing of reaching the top dead center are connected to the crankpin 20C as the first crankpin. On the other hand, one piston 19B is connected to the crankpin 20B as the second crankpin. Accordingly, the timings of the upward strokes of the two pistons 19A and 19D in the isolated crank chamber 17A are shifted from each other, and the timings of the upward strokes of the two pistons 19C and 19E in the isolated crank chamber 17C are shifted from each other.

Further, the maximum volume of each of the isolated crank chambers 17A and 17C is larger than that of the isolated crank chamber 17B. As a result, the degree of pressure reduction by the upward strokes of the pistons 19A and 19D in the isolated crank chamber 17A is smaller than that by the upward stroke of the piston 19B in the isolated crank chamber 17B. Similarly, the degree of pressure reduction by the upward strokes of the pistons 19C and 19E in the isolated crank chamber 17C is smaller than that by the upward stroke of the piston 19B in the isolated crank chamber 17B. Accordingly, the minimum value of the pressure in the isolated crank chamber 17B is smaller than that of the pressure in each of the isolated crank chambers 17A and 17C.

Due to the above fact, there is a possibility that the oil stored in the oil collecting pan 120 may flow in a reverse flow into the isolated crank chamber 17B during the upward stroke of the piston 19B. During the downward strokes of the pistons 19A and 19D connected to the crankpin 20A and the pistons 19C and 19E connected to the crankpin 20C, the pressures in the isolated crank chambers 17A and 17C rise and the pressure in the oil collecting pan 120 also rises, so that the above reverse flow phenomenon occurs more easily. In this preferred embodiment, however, reverse flow of the oil stored in the oil collecting pan 120 into the isolated crank chambers 17A and 17C hardly occurs from the viewpoints of the timings where the pistons 19A and 19D and the pistons 19C and 19E reach the respective top dead centers and of the maximum volumes of the isolated crank chambers 17A and 17C.

In view of the above circumstances, the engine 1 in the second preferred embodiment is provided with reverse flow preventing means for preventing reverse flow of the oil stored in the oil collecting pan 120 into the isolated crank chamber 17B due to a pressure reduction in the isolated crank chambers 17A, 17B, and 17C.

This means will now be described more specifically.

Referring to FIGS. 17 and 18, the annular oil pan abutting surface 3*b* for connection of the oil pan 25 is formed at the lower portion of the lower crankcase 3, and the oil collecting pan abutting surface 3*c* for connection of the oil collecting pan 120 is formed on the bottom wall 15L1 of the crank chamber 17 inside the abutting surface 3*b*. The abutting surface 3*c* defines three isolated openings 102A, 102B, and 102C separated from each other by two partition walls 100 and 101 spaced apart in the crank axial direction, and also defines an oil passage 111 communicating with an outlet oil passage 163 of a feed pump 152 to be hereinafter described.

The abutting surface 3*c* is composed of a surrounding portion 3*c*1 for surrounding all of the openings 102A, 102B, and 102C, the end surfaces 100*a* and 101*a* of the partition walls 100 and 101, and the oil passage 111, and a partitioning portion 3*c*2 connected to the surrounding portion 3*c*1 for partitioning the oil passage 111 from the openings 102A, 102B, and 102C.

The openings 102A, 102B, and 102C communicate with the isolated crank chambers 17A, 17B, and 17C through the oil outlet holes 53A, 53B, and 53C formed in the bottom wall 15L1, respectively. The openings 102A, 102B, and 102C are formed as recesses isolated by the partition walls 100 and 101 integral with the bottom wall 15L1. The oil passage 111 communicates with the oil filter 46 through another oil passage 112 formed in the bottom wall 15L1.

Referring to FIGS. 17 and 19(A), the oil collecting pan 120 is integral with a pump body 153 of the oil pump unit 150. The oil collecting pan 120 covering all of the oil outlet holes 53A, 53B, and 53C and all of the openings 102A, 102B, and 102C has an upper mount surface 121 to be connected to the abutting surface 3*c* (FIG. 18) when the oil pump unit 150 is fixed to the lower crankcase 3 by bolts 128; a collecting portion 122 forming an oil reservoir 123 defined by the mount surface 121 so as to cover the openings 102A, 102B, and 102C and the partition walls 100 and 101; a holding portion H for holding the reed valve 140; and an oil passage forming portion 126 forming the outlet oil passage 163 defined by the mount surface 121 so as to be aligned with the oil passage 111 (FIG. 18).

The oil collecting pan 120 is formed with an oil passage 133 as a hole having an inlet 133*a* and an outlet 133*b* both opening to the mount surface 121, and also formed with a plurality of through holes 127 for insertion of the bolts 128 to be threadedly engaged with a plurality of tapped holes 103 of the abutting surface 3*c* (FIG. 18).

The mount surface 121 is composed of a surrounding portion 121*a* and a partitioning portion 121*b* respectively aligned with the surrounding portion 3*c*1 and the partitioning portion 3*c*2. The mount surface 121 is formed with a packing groove 132 in which a single packing 131 is mounted so as to surround the oil reservoir 123 and the outlet oil passage 163. The oil collecting pan 120 is mounted through this packing 131 to the lower crankcase 3.

The collecting portion 122 functions to collect the oil falling from the isolated crank chambers 17A, 17B, and 17C through the oil outlet holes 53A, 53B, and 53C and the openings 102A, 102B, and 102C into the oil reservoir 123. The collecting portion 122 has an oil outlet opening 129 formed at the deepest portion of the oil reservoir 123 so as to communicate with an inlet oil passage 161 of the scavenging pump 151. The collecting portion 122 further has a guide portion 130 as a bottom wall for guiding the oil received by the oil reservoir 123 to the oil outlet opening 129.

Referring to FIG. 19(B), the holding portion H is composed of a pair of shoulder portions 122*a* and 122*b* and a pair of projecting portions 124 and 125. The shoulder portions 122*a* and 122*b* are formed inside the collecting portion 122 adjacent to the mount surface 121 at the opposite positions in a direction perpendicular to the crank axial direction as viewed in a direction perpendicular to the mount surface 121. The projecting portions 124 and 125 are formed so as to upward project from the guide portion 130 toward the partition walls 100 and 101 at the opposite positions in the crank axial direction. The projecting portions 124 and 125 also have shoulder portions 124*a* and 125*a*, respectively. The reed valve 140 is placed on the shoulder portions 122*a* and 122*b* and the shoulder portions 124*a* and 125*a* and held by the collecting portion 122 and the projecting portions 124 and 125, thus being fixed in the oil reservoir 123.

The oil outlet opening 129 is positioned with respect to the oil reservoir 123 so as to be aligned with the opening 102C in an axial direction of a pump shaft 156 of the scavenging pump 151 (which direction will be hereinafter referred to also as "pump axial direction") as viewed in a direction perpendicular to the abutting surface 3*c* or the mount surface 121.

Therefore, most of the oil from the isolated crank chamber 17C through the oil outlet hole 53C and the opening 102C directly flows into the oil outlet opening 129, and the remaining oil flows along the guide portion 130 toward the oil outlet opening 129 and then enters the oil outlet opening 129. On the other hand, all of the oil from the isolated crank chamber 17A through the oil outlet hole 53A and the opening 102A flows along the guide portion 130 toward the oil outlet opening 129 and then enters the oil outlet opening 129.

The oil passage 133 makes communication between the main gallery 60 formed in the lower crankcase 3 and the oil passage 61 for supplying oil to the transmission 28. The oil collecting pan 120, i.e., the oil pump unit 150 is fixed to the crankcase R by the bolts 128.

Referring to FIGS. 17, 19(A), 19(B), and 20, the reed valve 140 as a one-way valve which is an example of the reverse flow preventing means is provided for only the isolated crank chamber 17B of the three isolated crank chamber 17A, 17B, 17C into which the oil stored in the oil collecting pan 120 may flow in a reverse direction during the upward stroke of the piston 19B as mentioned above.

The reed valve 140 has a valve body 141, a reed 144 as a valve element, and a stopper 145. The valve body 141 has a valve hole 142 and a seal member 143 provided on the outer periphery. The reed 144 functions to open or close the valve hole 142 according to the difference between the pressure in the isolated crank chamber 17B and the pressure in the oil reservoir 123 of the oil collecting pan 120. The stopper 145 functions to restrict the movement of the reed 144 in opening the valve hole 142. The stopper 145 has a curved portion formed with a through hole 146.

The valve body 141 is placed on the shoulder portions 122*a*, 122*b*, 124*a*, and 125*a*, and is held by the collecting portion 122 and the projecting portions 124 and 125. The seal member 143 having rubber elasticity abuts against the collecting portion 122 and the projecting portions 124 and 125, and is elastically deformed to thereby generate an elastic force. Owing to this elastic force, the valve body 141 is held to the holding portion H.

In the condition where the oil collecting pan 120, i.e., the oil pump unit 150 is mounted on the lower crankcase 3, the upper surface of the seal member 143 is in almost full contact with the portions 3*c*1*a* and 3*c*1*b* of the abutting surface 3*c* and the lower end surfaces 100*a* and 101*a* as forming a sealing surface surrounding the opening 102B, thereby tightly sealing a connected portion between the opening 102B and the reed valve 140. In FIG. 19(A), the lower end surfaces 100*a* and 101*a* are shown so as to be slightly shifted from the seal member 143 for the convenience of illustration.

Thus, the reed valve 140 is built in the oil collecting pan 120 in such a manner as to be held by the holding portion H as utilizing the oil reservoir 123. The reed valve 140 is provided for only the oil outlet hole 53B of the three oil outlet holes 53A, 53B, and 53C, or for only the opening 102B of the three openings 102A, 102B, and 102C. In the condition where the oil collecting pan 120 (i.e., the oil pump unit 150 in this preferred embodiment) is mounted on the lower crankcase 3, the reed valve 140 is mounted to the lower crankcase 3 in such a manner as to be held between the collecting portion 122 of the oil collecting pan 120 and the bottom wall 15L1 of the lower crankcase 3.

When the pressure in the isolated crank chamber 17B becomes lower than the pressure in the oil reservoir 123 of the collecting portion 122 during the upward stroke of the piston 19B (FIG. 2), the reed 144 is operated to close the valve hole 142, thus closing the reed valve 140.

Accordingly, the oil stored in the oil reservoir 123 or the oil outlet opening 129 of the oil collecting pan 120 is prevented from reversely flowing through the opening 102B and the oil outlet hole 53B into the isolated crank chamber 17B. At this time, the oil stored in the oil storing portion 54 flows through the oil outlet hole 53B to the opening 102B defined between the valve hole 142 and the oil outlet hole 53B, and is stored in the opening 102B as shown in FIG. 17.

Conversely, when the pressure in the isolated crank chamber 17B becomes higher than the pressure in the oil reservoir 123, the reed 144 is operated to open the valve hole 142, thus opening the reed valve 140. Accordingly, the oil in the isolated crank chamber 17B falls through the oil outlet hole 53B, the opening 102B, and the valve hole 142 into the oil reservoir 123. Therefore, most of the oil from the isolated crank chamber 17B through the oil outlet hole 53B, the opening 102B, and the reed valve 140 flows along the guide portion 130 toward the oil outlet opening 129 positioned adjacent to the reed valve 140 in the pump axial direction, and then enters the oil outlet opening 129, and the remaining oil passed through the reed valve 140 directly enters the oil outlet opening 129.

In this manner, the reed valve 140 functions to limit the oil flow through the oil outlet hole 53B between the isolated crank chamber 17B and the oil collecting pan 120 to only the unidirectional flow from the isolated crank chamber 17B toward the oil collecting pan 120.

As best shown in FIGS. 19(A) and 20, the reed valve 140 is shifted in position from the oil outlet opening 129 in the pump axial direction. More specifically, the valve hole 142 and the reed 144, or the whole of the reed valve 140 is positioned so as not to overlap with the oil outlet opening 129 at all in the pump axial direction as viewed in a direction perpendicular to the abutting surface 3*c* or the mount surface 121. Further, the reed valve 140 is arranged so that a virtual plane P parallel to the direction of movement of the reed 144 in its opening or closing operation is substantially perpendicular to the direction of oil flow along the guide portion 130 toward the oil outlet opening 129.

Further, since the stopper 145 has the through hole 146, the oil present between the reed 144 and the stopper 145 can be easily removed from the through hole 146. Accordingly, there is almost no possibility that the opening operation of the reed valve 140 may be hindered by the oil present between the reed 144 and the stopper 145.

Referring to FIGS. 17, 19(A), and 20, the oil pump unit 150 includes a pump body 153 provided commonly for the scavenging pump 151 and the feed pump 152 as a trochoid pump for each, first and second pump covers 154 and 155 connected to the opposite end surfaces of the pump body 153 in the pump axial direction by means of bolts 159, a pump shaft 156 rotatably supported to the pump body 153 and the first and second pump covers 154 and 155, and first and second pump rotors 157 and 158 adapted to be rotatably driven by the pump shaft 156.

The scavenging pump 151 includes the pump body 153 formed with the inlet oil passage 161 communicating with the oil outlet opening 129, and the first pump cover 154 for accommodating an inner rotor 157*a* and an outer rotor 157*b* constituting the first pump rotor 157. The oil drawn from the oil outlet opening 129 is discharged from an outlet port 162*a* provided at the tip end of an outlet oil passage 162 formed both in the first pump cover 154 and in the pump body 153. The oil discharged from the outlet port 162*a* lubricates the gears of the transmission 28 and then falls into the oil pan 25.

The feed pump 152 includes the pump body 153 formed with an outlet oil passage 163, and the second pump cover 155 for accommodating an inner rotor 158*a* and an outer rotor 158*b* constituting the second pump rotor 158. The second pump cover 155 is formed with an inlet oil passage 164. An oil strainer 165 through which the oil from the oil pan 25 is connected to the second pump cover 155. A relief valve 166 for making communication between the outlet oil passage 163 and the inlet oil passage 164 is accommodated in the pump body 153.

Referring to FIGS. 17 and 18, the oil discharged through the outlet oil passage 163 of the feed pump 152 is fed through the oil passage 111, the oil filter 46, the oil passages 112 and 113, the oil cooler 47, and the oil passage 114 to the main gallery 60. A part of the oil from the main gallery 60 is supplied through the oil passage 70 of the lower support wall 51C to the corresponding bearing portion 52 for the crankshaft 18 and further supplied through the oil passage 72 of the upper support wall 50C to the upper oil gallery 73 and thereafter to the nozzles 74 and the valve trains. Another part of the oil from the main gallery 60 is supplied through the oil passage 133 and the oil passage 61 to the necessary portions to be lubricated in the transmission 28.

According to the second preferred embodiment, the following effects can be exhibited in addition to the effects similar to those of the first preferred embodiment.

By the provision of the reed valve 140 for limiting the oil flow through the oil outlet hole 53B between the isolated crank chamber 17B and the oil collecting pan 120 to the unidirectional flow from the isolated crank chamber 17B toward the oil collecting pan 120, reverse flow of the oil from the oil collecting pan 120 to the isolated crank chamber 17B can be prevented by the reed valve 140. Accordingly, the discharge efficiency of oil from the isolated crank chamber 17B through the oil outlet hole 53B to the oil collecting pan 120 can be improved.

The reed valve 140 is provided for only the isolated crank chamber 17B accommodating the crankpin 20B, so that it is possible to prevent the reverse flow from the oil collecting pan 120 to the isolated crank chamber 17B, in which the reverse flow easily occurs. As compared with the case where a plurality of reed valves are provided respectively for all of the isolated crank chambers 17A, 17B, and 17C, the number of necessary reed valves can be reduced. Thus, the number of parts can be reduced and an assembly man-hour and cost can therefore be reduced.

When the reed valve 140 is closed, the oil stored in the oil storing portion 54 flows from the oil outlet hole 53B to the opening 102B, provided between the valve hole 142 and the oil outlet hole 53B, and is stored in the opening 102B. Thus, the opening 102B serves also as an additional oil storing space, so that the amount of oil gathering in the oil storing portion 54 is reduced and a rise in oil level at the lower portion of the isolated crank chamber 17B can be suppressed. As a result, it is possible to prevent or suppress that the crankshaft 18 may stir the oil stored in the oil storing portion 54, thereby preventing or suppressing the occurrence of output loss.

The reed valve 140 is accommodated in the oil reservoir 123 of the oil collecting pan 120, and is operated to open or close according to the difference between the pressure in the isolated crank chamber 17B and the pressure in the oil collecting pan 120 applied o the reed 144. Furthermore, the reed valve 140 is shifted in position from the oil outlet opening 129 in the pump axial direction.

Accordingly, the reed valve 140 is located by utilizing the oil reservoir 123 of the oil collecting pan 120, so that an increase in size near the oil collecting pan 120 can be suppressed in spite of the provision of the reed valve 140. Moreover, also in the open condition of the reed valve 140, the oil flow toward the oil outlet opening 129 in the oil collecting pan 120 is not hindered by the reed valve 140.

The reed valve 140 built in the oil collecting pan 120 is arranged so that the virtual plane P parallel to the direction of opening/closing movement of the reed 144 is substantially perpendicular to the direction of oil flow along the guide portion 130 toward the oil outlet opening 129. Accordingly, in the open condition of the reed valve 140, the oil flowing along the guide portion 130 in the direction substantially perpendicular to the virtual plane P is passed along both surfaces 144*a* and 144*b* (see FIG. 19(B)) of the reed 144 as a thin member. As a result, it is possible to suppress that the reed 144 and the stopper 145 may hinder the oil flow in the collecting portion 122.

Since the stopper 145 has the through hole 146, the oil present between the reed 144 and the stopper 145 can be easily removed from the through hole 146. Accordingly, there is almost no possibility that the opening operation of the reed valve 140 may be hindered by the oil present between the reed 144 and the stopper 145, so that the reed valve 140 can be quickly opened to thereby improve the discharge efficiency of oil from the isolated crank chamber 17B to the oil collecting pan 120.

The reed valve 140 is held between the lower crankcase 3 and the oil collecting pan 120. Accordingly, any special member for mounting the reed valve 140 is not required, so that the number of parts can be reduced and an assembly man-hour and cost can therefore be reduced.

In the condition where the oil collecting pan 120 is mounted on the lower crankcase 3, the connected portion between the opening 102B and the reed valve 140 is tightly sealed by the seal member 143 of the reed valve 140. Accordingly, it is not necessary to form a groove for mounting a packing coming into contact with the end surfaces 100*a* and 101*a* as a seal surface on the mount surface 121 of the oil collecting pan 120, so that the structure of the oil collecting pan 120 can be simplified to thereby reduce the cost.

The oil collecting pan 120 is integral with the pump body 153 of the scavenging pump 151. Accordingly, a man-hour for assembling the oil collecting pan 120 and the oil pump unit 150 including the scavenging pump 151 can be reduced.

Some modifications obtained by modifying a part of the configuration of the second preferred embodiment will now be described in brief.

The reed valve 140 may be located at any arbitrary position in an oil flowing path from the isolated crank chamber 17B to the oil outlet opening 129. For example, the reed valve 140 may be located between the oil outlet hole 53B and the opening 102B. Further, any valves other than the reed valve 140 may be used as the one-way valve.

The multicylinder internal combustion engine may be a V-type internal combustion engine having any odd-number cylinders other than five cylinders, a V-type internal combustion engine having even-number cylinders, or any multicylinder internal combustion engine other than the V-type engine. In the case that the oil flows in a reverse direction to each isolated crank chamber, the reed valve 140 may be provided for each isolated crank chamber. For example, the crankshaft may have at least a first crankpin to which a first piston is connected and a second crankpin to which a second piston is connected, the second piston being different from the first piston in timing of reaching a top dead center, and the reed valve 140 may be provided for each of first and second isolated crank chambers respectively accommodating the first and second crankpins.

Accordingly, even in a multicylinder internal combustion engine wherein a phase difference is generated in pressure change between the plural isolated crank chambers because of different phases of the pistons, reverse flow of the oil from the oil collecting pan to each isolated crank chamber can be prevented by each reed valve 140, so that the discharge efficiency of oil to the oil collecting pan can be improved.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

What is claimed is:

1. A multicylinder internal combustion engine having a crankcase integrally formed with a plurality of support walls for supporting a crankshaft, a plurality of isolated crank chambers formed by partitioning a space inside of said crankcase with said support walls, and a plurality of oil outlet holes respectively communicating with said plurality of isolated crank chambers to separately discharge oil from said isolated crank chambers, said multicylinder internal combustion engine comprising:

a crank chamber oil collecting pan mounted on a bottom wall of said crankcase so as to cover all of said oil outlet holes for collecting the oil passed through said oil outlet holes, said crank chamber oil collecting pan having an oil reservoir formed with an oil outlet opening; and a scavenging pump for drawing the oil stored in said crank chamber oil collecting pan through said oil outlet opening.

2. The multicylinder internal combustion engine according to claim 1, wherein said scavenging pump is mounted on said crank chamber oil collecting pan.

3. The multicylinder internal combustion engine according to claim 1, wherein said crank chamber oil collecting pan has an upper mount surface connected to said bottom wall, said upper mount surface being formed with a groove as an oil passage.

4. The multicylinder internal combustion engine according to claim 1, further comprising a one-way valve for limiting the oil flow through said oil outlet holes between said isolated crank chambers and said crank chamber oil collecting pan to a unidirectional flow from said isolated crank chambers to said crank chamber oil collecting pan.

5. The multicylinder internal combustion engine according to claim 4, wherein said crankshaft has at least a first crankpin to which a first piston is connected and a second crankpin to which a second piston is connected, said second piston being different from said first piston in timing of reaching a top dead center, and wherein said one-way valve is provided for each of said isolated crank chambers respectively accommodating said first and second crankpins.

6. The multicylinder internal combustion engine according to claim 4, wherein said crankshaft has a first crankpin to which two pistons different in timing of reaching a top dead center are connected, and a second crankpin to which one piston is connected, and wherein said one-way valve is provided for only one of said isolated crank chambers accommodating said second crankpin.

7. The multicylinder internal combustion engine according to claim 4, wherein said one-way valve is accommodated in said oil reservoir of said crank chamber oil collecting pan and is operated to open or close according to a difference between a pressure in each isolated crank chamber and a pressure in said crank chamber oil collecting pan applied to a valve element, and wherein said one-way valve is shifted in position from said oil outlet opening in an axial direction of said scavenging pump.

8. The multicylinder internal combustion engine according to claim 4, wherein said one-way valve is held between said crankcase and said crank chamber oil collecting pan.

9. The multicylinder internal combustion engine according to claim 2, wherein said crank chamber oil collecting pan has an upper mount surface connected to said bottom wall, said upper mount surface being formed with a groove as an oil passage.

10. The multicylinder internal combustion engine according to claim 2, further comprising a one-way valve for limiting the oil flow through said oil outlet holes between said isolated crank chambers and said crank chamber oil collecting pan to the unidirectional flow from said isolated crank chambers to said crank chamber oil collecting pan.

11. A multicylinder internal combustion engine comprising:

a crankcase for housing multiple cylinders arranged in a V-shape, the crankcase including:

multiple support walls for supporting a crankshaft, multiple isolated crank chambers formed by partitioning a space inside of said crankcase with said support walls, and multiple oil outlet holes respectively communicating with said multiple isolated crank chambers to separately discharge oil from said isolated crank chambers;

a crank chamber oil collecting pan mounted on a bottom wall of said crankcase covering all of said oil outlet holes for collecting the oil passed through said oil outlet holes, said crank chamber oil collecting pan having an oil reservoir formed with an oil outlet opening; and a scavenging pump for drawing the oil stored in said crank chamber oil collecting pan through said oil outlet opening.

12. The multicylinder internal combustion engine according to claim 11, wherein said scavenging pump is mounted on said crank chamber oil collecting pan.

13. The multicylinder internal combustion engine according to claim 11, wherein said crank chamber oil collecting pan has an upper mount surface connected to said bottom wall, said upper mount surface being formed with a groove as an oil passage.

14. The multicylinder internal combustion engine according to claim 11, further comprising a one-way valve for limiting the oil flow through said oil outlet holes between said isolated crank chambers and said crank chamber oil collecting pan to a unidirectional flow from said isolated crank chambers to said crank chamber oil collecting pan.

15. The multicylinder internal combustion engine according to claim 14, wherein said crankshaft has at least a first crankpin to which a first piston is connected and a second crankpin to which a second piston is connected, said second piston being different from said first piston in timing of reaching a top dead center, and wherein said one-way valve is provided for each of said isolated crank chambers respectively accommodating said first and second crankpins.

16. The multicylinder internal combustion engine according to claim 14, wherein said crankshaft has a first crankpin to which two pistons different in timing of reaching a top dead center are connected and a second crankpin to which one piston is connected, and wherein said one-way valve is provided for only one of said isolated crank chambers accommodating said second crankpin.

17. The multicylinder internal combustion engine according to claim 14, wherein said one-way valve is accommodated in said oil reservoir of said crank chamber oil collecting pan and is operated to open or close according to a difference between a pressure in each isolated crank chamber and a pressure in said crank chamber oil collecting pan applied to a valve element, and wherein said one-way valve is shifted in position from said oil outlet opening in an axial direction of said scavenging pump.

18. The multicylinder internal combustion engine according to claim 14, wherein said one-way valve is held between said crankcase and said crank chamber oil collecting pan.

19. The multicylinder internal combustion engine according to claim 12, wherein said crank chamber oil collecting pan has an upper mount surface connected to said bottom wall, said upper mount surface being formed with a groove as an oil passage.

20. The multicylinder internal combustion engine according to claim 12, further comprising a one-way valve for limiting the oil flow through said oil outlet holes between said isolated crank chambers and said crank chamber oil collecting pan to the unidirectional flow from said isolated crank chambers to said crank chamber oil collecting pan.

* * * * *